US007270245B2

(12) United States Patent
Cheng et al.

(10) Patent No.: US 7,270,245 B2
(45) Date of Patent: Sep. 18, 2007

(54) MESH CONTAINER, SYSTEM USING MESH CONTAINERS, AND METHOD FOR MAKING MESH CONTAINERS

(75) Inventors: Hsi-Ming Cheng, Chung-Hua Hsien (TW); R. Neal Post, Springfield, IL (US); Christopher Hardy, Springfield, IL (US)

(73) Assignee: Design Ideas, Ltd., Springfield, IL (US)

( * ) Notice: Subject to any disclaimer, the term of this patent is extended or adjusted under 35 U.S.C. 154(b) by 0 days.

(21) Appl. No.: 10/972,308

(22) Filed: Oct. 22, 2004

(65) Prior Publication Data

US 2005/0056647 A1 Mar. 17, 2005

Related U.S. Application Data

(63) Continuation of application No. 10/308,699, filed on Dec. 3, 2002, now abandoned.

(51) Int. Cl.

| | |
|---|---|
| ***B65D 6/08*** | (2006.01) |
| ***B65D 6/32*** | (2006.01) |
| ***B65D 6/36*** | (2006.01) |
| *B65D 25/00* | (2006.01) |

(52) U.S. Cl. ..... 220/62.1; 220/62; 220/485; 220/607; 220/642; 220/676; 220/680; 211/126.15; 312/330.1

(58) Field of Classification Search ..... 220/485–487, 220/491–494, 9.1, 9.4, 6.2, 6.21, 62, 62.1, 220/607, 642, 676, 680; 312/330.1; 211/126.15, 211/71.01

See application file for complete search history.

(56) References Cited

U.S. PATENT DOCUMENTS 171,032 A 12/1875 Meyers
201,959 A 4/1878 Stockwell et al.
297,382 A 4/1884 Golding (Continued)

FOREIGN PATENT DOCUMENTS

DE 1083999 6/1960

(Continued)

OTHER PUBLICATIONS

Millers Office Products, p. 442, 1995.

(Continued)

*Primary Examiner*—Anthony D. Stashick
*Assistant Examiner*—Niki M. Eloshway
(74) *Attorney, Agent, or Firm*—SAIDMAN DesignLaw Group

(57) ABSTRACT

The present invention is directed to a container comprising a first piece of mesh material and at least one separate second piece of mesh material. The first piece of mesh is bent to form a bottom wall and a first pair of sidewalls. The second piece of material forms a second pair of sidewalls. When the pieces are joined together, a basket portion with an upwardly-extending opening is formed. The basket portion may further include a runner portion that may be a separate rail connected to the basket portion, thus forming a drawer. When the container is used with a drawer system including a frame, the runner portion is slidably received in a pair of frame runners. This allows the drawer to move with respect to the frame between retracted and extended positions. The present invention is also directed to a method for making such containers.

2 Claims, 18 Drawing Sheets

U.S. PATENT DOCUMENTS 403,046 A 5/1889 Heath
463,964 A 11/1891 Gates
645,344 A 3/1900 White
D33,268 S 9/1900 Rix
D33,269 S 9/1900 Rix
887,097 A 5/1908 Kimber
893,786 A 7/1908 Collis et al.
900,162 A 10/1908 Goodwin
903,848 A 11/1908 Donnelly
920,313 A 5/1909 Franklin
933,517 A 9/1909 Worcester
981,205 A 1/1911 Loetzer
994,984 A 6/1911 Dennis
1,098,053 A 5/1914 Porter
1,107,014 A 8/1914 Avery
1,138,196 A 5/1915 Martin
1,224,234 A 5/1917 Taber
1,305,148 A 5/1919 Montan
1,382,592 A 6/1921 Ames
1,384,755 A 7/1921 Hall
1,389,908 A 9/1921 Shults et al.
1,408,026 A 2/1922 Ochiltree
1,413,908 A 4/1922 Green
1,445,259 A 2/1923 Wiselogel
1,463,098 A 7/1923 Snyder
1,484,696 A 2/1924 Wulftange
RE16,431 E 9/1926 Kratzer
1,660,410 A 2/1928 Beckman
1,688,846 A 10/1928 Andrews
1,840,561 A 1/1932 Miller
1,890,983 A 12/1932 Griffith
1,950,921 A 3/1934 Gray et al.
1,961,144 A 6/1934 Griffith
1,994,553 A 3/1935 Wolcott
2,009,527 A 7/1935 Shelton
2,141,400 A 12/1938 Mack
2,356,675 A 8/1944 Lachman
2,408,082 A 9/1946 Mack
2,443,319 A 6/1948 Mack
D152,140 S 12/1948 Crawford et al.
D152,141 S 12/1948 Crawford et al.
2,502,781 A 4/1950 Erickson
2,507,152 A 5/1950 Garofalo
2,574,998 A * 11/1951 Bangert, Jr. ..... 220/62
2,658,444 A 11/1953 Wheeler
2,706,064 A 4/1955 Vitols
2,721,671 A 10/1955 Averill
2,768,022 A 10/1956 Pope
D182,349 S 3/1958 Alvord
2,825,481 A 3/1958 Glenny
2,826,329 A 3/1958 Beckner
2,851,186 A 9/1958 Rupe, Jr.
2,898,122 A 8/1959 Beckner
D189,544 S 1/1961 Harris
D189,550 S 1/1961 Alvord
2,993,615 A 7/1961 Bruce
D194,513 S 2/1963 Sparling
3,120,323 A 2/1964 Sparling
3,138,281 A 6/1964 Schray
3,152,566 A 10/1964 Dixon
D204,314 S 4/1966 Bright
3,250,430 A 5/1966 Cella
3,272,377 A 9/1966 Schray
D207,308 S 4/1967 Bell
D212,074 S 8/1968 Woodruff et al.
3,436,044 A 4/1969 Martinson
3,563,292 A 2/1971 Gordon
D222,238 S 10/1971 Rehrig
3,704,791 A 12/1972 Young, Jr.
3,923,187 A 12/1975 Johansson et al.
3,935,958 A 2/1976 Frangos
4,056,221 A * 11/1977 Piltz et al. ..... 229/164.1
4,173,289 A 11/1979 Nesti
4,205,406 A 6/1980 Wangkeo et al.
4,297,154 A 10/1981 Keller
4,339,048 A 7/1982 McMillen et al.
D267,395 S 12/1982 Groenewold et al.
4,509,805 A 4/1985 Welsch et al.
4,664,684 A 5/1987 Dunn et al.
D298,403 S 11/1988 Hagberg et al.
D300,488 S 4/1989 Yoshikawa
D303,444 S 9/1989 Yoshikawa
4,903,853 A * 2/1990 Lin ..... 220/6
4,945,748 A 8/1990 Worship et al.
D322,378 S 12/1991 Colman
D328,993 S 9/1992 Rosenthal
D341,459 S 11/1993 Yang
5,305,686 A 4/1994 Svensson
D360,531 S 7/1995 Griffith
D365,954 S 1/1996 Milroy
D373,039 S 8/1996 Cohen et al.
D383,283 S 9/1997 Hankins, III
D393,766 S 4/1998 Mazzola et al.
5,810,179 A 9/1998 Kleiman
5,842,789 A 12/1998 Derby et al.
D411,045 S 6/1999 Morandi
D416,165 S 11/1999 Zemel
D418,998 S 1/2000 Glassenberg
D419,302 S 1/2000 Hardy et al.
D431,907 S 10/2000 Andujar et al.
D432,752 S 10/2000 Andujar et al.
D433,709 S 11/2000 Hardy
D433,710 S 11/2000 Andujar
D433,711 S 11/2000 Andujar
D433,810 S 11/2000 Kellogg et al.
D434,074 S 11/2000 Hardy
D434,257 S 11/2000 Andujar
D436,044 S 1/2001 Subilia
D436,239 S 1/2001 Walsh
D437,354 S 2/2001 Andujar
D437,984 S 2/2001 Weiss et al.
D444,039 S 6/2001 Tong
D444,927 S 7/2001 Lin
D449,074 S 10/2001 Andujar
6,305,599 B2 10/2001 Tsubaki et al.
D450,453 S 11/2001 Andujar
D450,481 S 11/2001 Post
D451,675 S 12/2001 Hardy et al.
D453,027 S 1/2002 Andujar
D455,029 S 4/2002 Gusdorf
D455,292 S 4/2002 Hardy et al.
D460,848 S 7/2002 Tzeng
6,461,501 B1 10/2002 Porter
D465,947 S 11/2002 Andersen et al.
6,497,331 B1 12/2002 Morandi

FOREIGN PATENT DOCUMENTS

FR 826876 4/1938
FR 1444104 9/1966
GB 228338 2/1925
GB 730785 6/1955
JP HE16 12323 2/1994
JP HE16 47125 6/1994
JP 2001-270515 2/2001
JP 2001-199439 7/2001
TW 086202707 2/1998

OTHER PUBLICATIONS

Staples Catalogue, cover page and p. 457, issued 1996.
Design Ideas Holiday Catalogue, cover page and pp. 62 and 63, issued 1997.
Millers Office Products, p. 453, 1997.
Millers Office Products, p. 475, 1998.

Design Ideas Catalogue, cover page and pp. 61, 65, 69, and 77, issued 1998.
Design Ideas Holiday Catalogue, , cover page, p. Office Organization #4, issued 1999.
Hong Kong Enterprise, Oct. 1999, p. 98.
Hong Kong Enterprise, Oct. 1999, p. 1126.
Baigelman & Co., Office Products Catalog, 2000, item A, p. 492.
Jacobs Gardner Office Products 2001, item B circled, p. 474.
The Container Store, The Ultimate Planning Guide, revised Nov. 2001.

* cited by examiner (A)

(B)

(C)

(D)

【図7】

MESH CONTAINER, SYSTEM USING MESH CONTAINERS, AND METHOD FOR MAKING MESH CONTAINERS

CROSS-REFERENCE TO RELATED APPLICATIONS

This application is a continuation of our prior pending application Ser. No. 10/308,699, filed Dec. 3, 2002 now abandoned. This application claims priority from the prior ROC (Taiwan) Patent Application No. 090220946, filed Dec. 3, 2001; ROC (Taiwan) Patent Application No. 091202306, filed Apr. 16, 2002; and ROC (Taiwan) Patent Application No. 091214244, filed Sep. 11, 2002. The above-identified applications are incorporated by reference herein in their entirety.

BACKGROUND OF THE INVENTION

1. Field of the Invention

The present invention relates to containers, a system using such containers, and a method of making such containers. More particularly, the present invention relates to drawers made of mesh material.

2. Description of Related Art

Forming containers out of sheet metal is well known. U.S. Pat. No. 903,848 to Donnelly and U.S. Pat. No. 1,107,014 to Avery disclose such containers. In order to make these containers, a single blank of flat material is cut out and folded with overlapping sections. Sheet metal does not provide desirable characteristics such as drainage and ventilation.

In an effort to make a well-ventilated container, U.S. Pat. No. 645,344 to White discloses a container formed of perforated sheet metal, wire-netting or another open-work material. The White container is intended to have a folded state and a flat state. This container is designed to be readily knocked down from its folded state to its flat state and to be easily constructed without tools.

Other patents attempt to make lightweight, drainable and/or ventilated containers. U.S. Pat. No. 1,994,553 to Wolcott discloses one such container of finely woven wire screening. U.S. Pat. No. 2,825,481 to Glenny discloses another such container of finely woven wire screening. In order to make the White, Wolcott and Glenny containers, a single blank of flat woven wire is cut out and folded with overlapping sections.

Another wire container that is commercially available under the brand name Elfa® is formed of a wire grid with a plurality of separately formed wires welded together. The Elfa® container includes a basket portion and a flat rail around the top edge of the basket portion. The Elfa® baskets are designed for use in a frame having a plurality of pairs of runners. When the baskets are inserted in the frame, the flat rail is supported by a pair of runners and is movable between retracted and extended positions. The wire grid used for the Elfa® basket has large holes measuring about 1 inch by 1 inch. The Elfa® basket also has openings at its corners. If a user desires to store small objects in these baskets, a plastic liner can be used. The liner has a bottom wall and upwardly bendable sidewalls, with slits between the sidewalls to allow for such bending. The open corners of the basket and the slits between the sidewalls of the liner may allow small objects to fall out of the basket, which is undesirable.

Mesh material is typically formed by perforating or slitting a piece of sheet metal and stretching it. A sheet of mesh material requires less raw sheet metal than a non-mesh piece of sheet metal and a perforated piece of sheet metal. U.S. Pat. No. 1,408,026 to Ochiltree discloses a desk tray or basket formed of "expanded metal" or mesh material. Similar to the previous containers, the Ochiltree container is formed by a single blank of flat material that is cut out and folded.

ROC (Taiwan) Patent Application No. 086202709 to Chih-Ming, Ko (in transliteration), filed Feb. 21, 1997, discloses a system of containers supported by a frame. The containers are formed of a single piece of mesh with a rim connected thereto. Additionally, the containers do not move with respect to the frame so that the contents of the lower container are not easily accessible.

A number of mesh containers are made by Design Ideas, Ltd. One of these containers is the "Mesh Storage Nest." This container is formed using a first piece of mesh that has the ends welded together to form a loop. A second piece of mesh is welded to the lower edge of the loop so that the first piece of mesh forms sidewalls and the second piece of mesh forms a bottom wall. The seam at the bottom of the container is covered by a bottom rail. A top rail is connected to the upper edge of the container. The sidewalls can be shaped to include a plurality of corners.

A need exists for a lightweight container that can be incorporated into a system for storing objects. It is also desirable that the contents of such a container be made easily accessible and be prevented from accidentally falling through holes in the container. Furthermore, it is desirable that the container be formed by an economical method in unlimited sizes. The present invention was developed with the above-noted general objects in mind.

SUMMARY OF THE INVENTION

The present invention is directed to a container or drawer comprising first and second pieces of mesh material. The first piece of mesh forms a bottom wall and two spaced apart first and second sidewalls that extend upwardly from the bottom wall. The second piece of mesh material is formed separate from the first piece of mesh material. The second piece of mesh material includes third and fourth sidewalls. The second piece of mesh material is joined to the first piece of mesh material to form a basket portion. The basket portion may further include a runner portion that may be a rail separately formed from the basket portion.

In one embodiment, the basket portion includes open corners between the sidewalls. In another embodiment, the third and fourth sidewalls include extensions for overlapping the first and second sidewalls so that closed corners are formed between the sidewalls. In such an embodiment, the corners may be curved.

Preferably, one drawer and more preferably, a plurality of drawers are useful with a frame in a storage system. Each drawer is moveable with respect to the frame between retracted and extended positions. In such an embodiment, the frame may further include a pair of runners with a gap therein for slidably receiving the runner portion of each drawer.

The present invention is also directed to a container comprising first, second, and third pieces of mesh material. The first piece of mesh forms a bottom wall and first and second spaced apart sidewalls that extend upwardly from the bottom wall. The second piece of mesh material is formed separate from the first piece of mesh material. The third piece of mesh material is formed separate from the first and second pieces of mesh material. The second and third pieces of mesh material are joined to the bottom wall by a pair of bottom seams. Additionally, the second and third pieces of mesh material are joined to the end walls by a plurality of generally vertically extending side seams that all combine to form a basket portion.

The basket portion may further include runner portion. In such an embodiment, the runner portion may be a rail that may be separately formed from the basket portion.

In one embodiment, the rail is preferably a flat piece of material and can include a curved portion. In the latter rail embodiment, the curved portion defines an opening in an uncompressed state for receiving the upper section of the basket portion, and in a compressed state the opening is minimized.

BRIEF DESCRIPTION OF THE DRAWINGS

The present invention will be more fully appreciated as the same becomes understood from the following detailed description of the best mode presently contemplated for carrying out the present invention when viewed in conjunction with the accompanying drawings, in which.

DETAILED DESCRIPTION OF THE PREFERRED EMBODIMENTS

Figure 1:
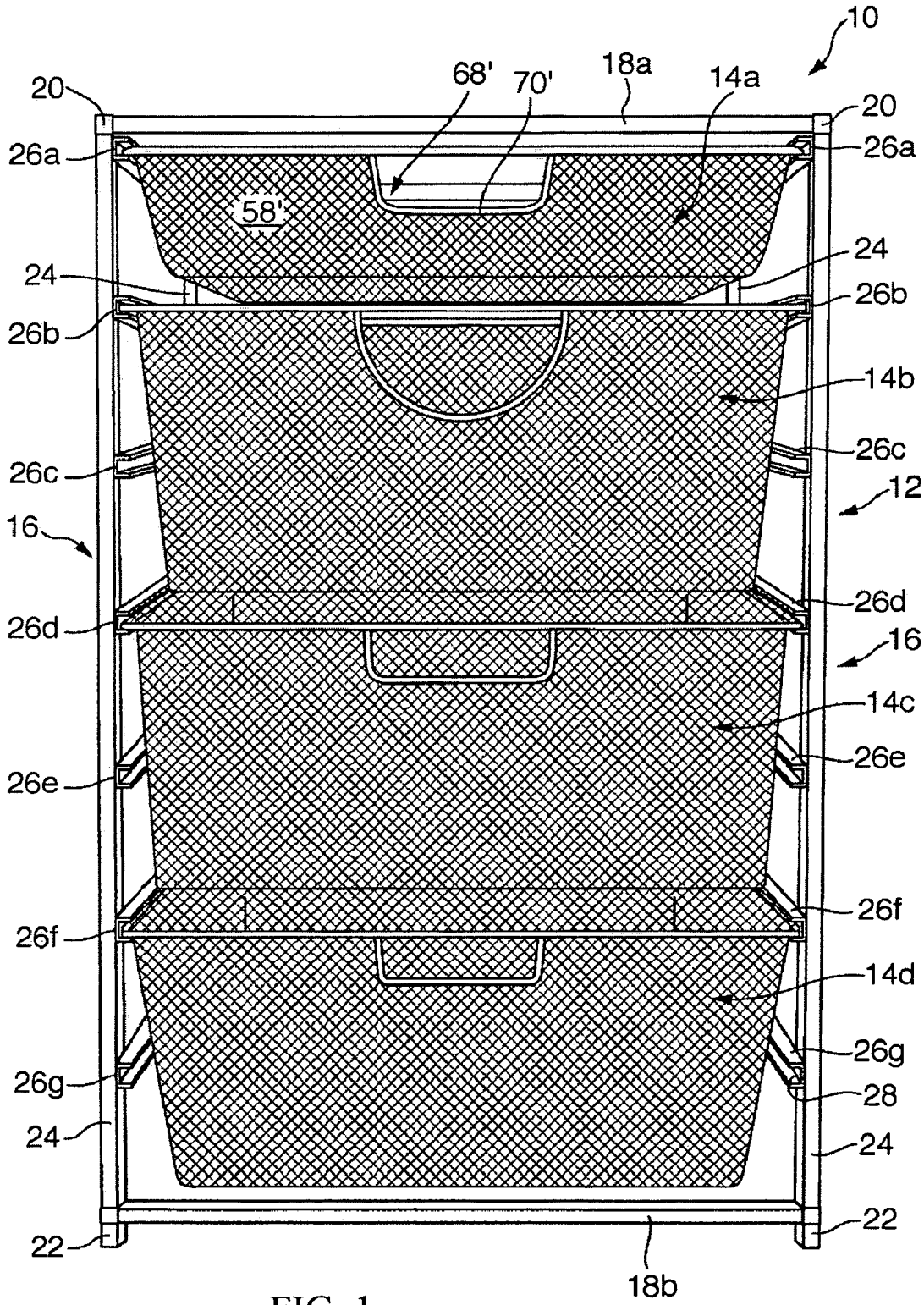
FIG. 1 is front, perspective view of a first preferred embodiment of a system of drawers of the present invention, where the drawers are in a retracted position.

Referring to FIG. 1, a preferred, first embodiment of a drawer system 10 is shown. This drawer system 10 may be used to store a variety of housewares, such as kitchen items, clothing, accessories, sports equipment, shoes, bathroom supplies, tools, appliances, and the like. Additionally, the system 10 can be used to store a variety of other items, for example food, office supplies, office equipment, file folders, papers/documents, bags, boxes, cans, bottles, etc.

The drawer system 10 includes a frame 12 and a plurality of containers or drawers 14*a-d*. The drawer 14*a* is smaller than the drawers 14*b-c* so drawer 14*a* can hold a smaller volume than the other drawers 14*b-d*. The drawers 14*a-d* are movable with respect to the frame 12 between a retracted position (shown in FIG. 1) and an extended position. In the retracted position, the contents of the lower drawers 14*b-d* is difficult to access. In the extended position, the contents of the extended drawer are easily accessible; the extended drawer may be fully withdrawn from frame 12 if desired.

With reference to FIG. 1, frame 12 includes two side frame members or ladders 16 that are spaced apart and joined by pairs of upper and lower cross members 18*a,b*, respectively. The side frame members 16 and the pairs of upper and lower cross members 18*a,b* are formed to give the frame 12 a rectangular shape. The present invention is not limited to this frame shape.

Figure 2A:
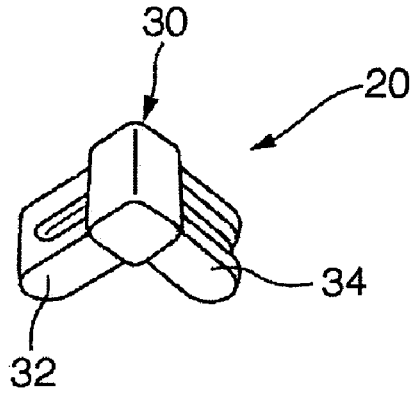
FIG. 2A is an enlarged, perspective view of an L-connector for use with the system of FIG. 1.
Figure 2B:
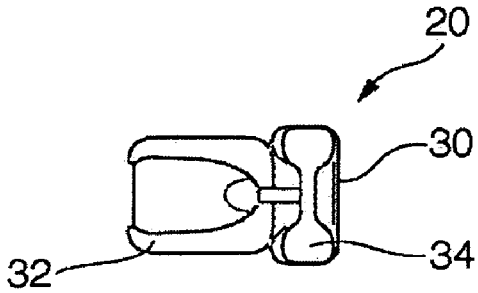
FIG. 2B is an enlarged, end view of the L-connector shown in FIG. 2A.

The frame 12 further includes L-connectors 20 (as best seen in FIG. 2A) and T-connectors 22 (as best seen in FIG. 2B) for joining the side frame members 16 to the cross frame members 18*a,b*. Preferably, L-connectors 20 connect upper cross member 18*a* to the side frame members 16, if no additional frames are to be added above the one illustrated in FIG. 1. If an additional frame is to be added above the frame 12 shown in FIG. 1, T-connectors 22 are used to join upper cross members 18*a* to frame members 16. Preferably, T-connectors 22 also connect lower cross members 18*b* to the side frame members 16. Alternatively, the T-connectors 22 joined to the lower cross members 18*b* can be replaced with plugs with casters (not shown) thereon to make the system 10 movable, as is apparent to those of ordinary skill in the art.

Referring again to FIG. 1, each side frame member 16 includes a pair of spaced apart vertical rods 24 coupled by vertically spaced apart horizontally-extending runners 26*a-g*. Each side frame member 16 is formed so that the runners 26*a-g* of each side frame member 16 are aligned with the runners 26*a-g* of the other side frame member 16 to form a plurality of pairs of runners. Each runner 26*a-g* is a generally U-shaped member with an inwardly extending gap 28 defined therein. The runners 26*a-g* may include a bore (not shown) in the rear end for receiving a pin (not shown) for preventing rearward movement of the drawers 14*a-d* out of the frame 12. To make the frame independent of direction the bore (not shown) may be formed at both ends of each runner and the pin (not shown) disposed in the desired end for use.

The frame 12 is preferably formed of any metal with sufficient rigidity and formability, for example mild sheet steel, stainless steel, aluminum, copper or the like can be used. The vertical rods 24 and the runners 26*a-g* are preferably welded together using conventional welding techniques. The frame 12 may be subjected to a powder painting treatment, similar to that discussed below for the drawers 14*a-d*.

Figure 2C:
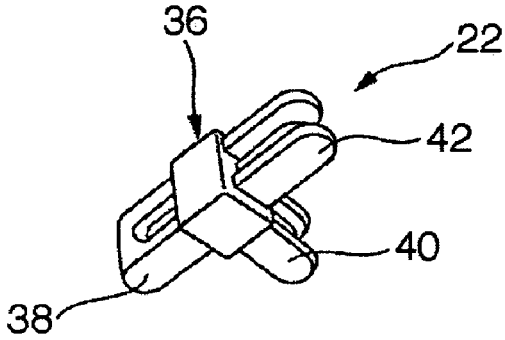
FIG. 2C is an enlarged, perspective view of a T-connector for use with the system of FIG. 1.
Figure 2D:
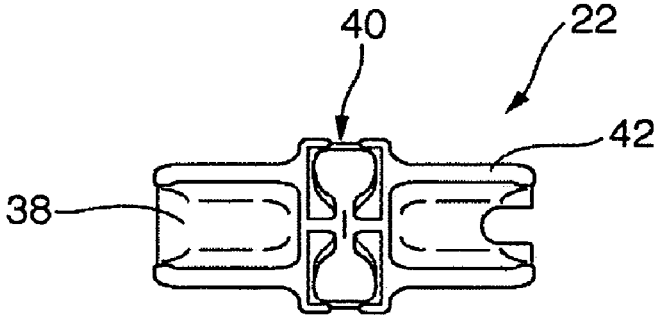
FIG. 2D is an enlarged, end view of the T-connector shown in FIG. 2C.

Referring to FIGS. 1, 2A and 2B, the L-connector 20 includes a central body 30 and first and second generally perpendicular legs 32 and 34 extending therefrom. Preferably, the pairs of cross members 18*a,b* and vertical rods 24 are hollow so that the legs 32 and 34 are received therein to join these components together. Referring to FIGS. 1, 2C and 2D, the T-connector 22 includes a central body 36 and first, second, and third legs 38, 40, and 42, respectively, extending therefrom. First and second legs 38 and 40 are generally perpendicular to one another similar to L-connector 20. Third and second legs 40 and 42 are also generally perpendicular to one another. Preferably, the first leg 38 and the third leg 42 may be inserted into the hollow vertical rods 24, and the second leg 40 is inserted in the hollow associated cross members 18*a,b*.

The L-connectors 20 and T-connectors 22 are preferably formed of any metal with sufficient rigidity and formability. For example, the connectors 20 and 22 can be cast of die-cast aluminum or any alloy, using conventional techniques known to those of ordinary skill in the art. These connectors 20 and 22, however, can also be formed of another material like injection molded plastic.

Now, with reference to FIGS. 1, 3, and 3A, the details of the drawer 14*b* will be discussed. The drawer 14*b* includes a runner portion that comprises upper rail 54 and a basket portion 55. The basket portion 55 is coupled to the upper rail 54. In the present embodiment, the basket portion 55 is formed of expanded metal plate (i.e., sheet metal) or "mesh" and has small openings 55*a* therein. In the present specification and appended claims "mesh" means flat metal that is pierced and stretched so that no material is separated from the original raw material, as known by those of ordinary skill in the art. On the other hand, unlike mesh, punching portions of waste material out of sheet metal material forms perforated metal. Preferably, the opening 55*a* (see FIG. 3) in the mesh has an area less than 25.4 mm by 25.4 mm (1 inch by 1 inch), more preferably less than 20 mm by 10 mm (0.79 inches by 0.39 inches), and most preferably, less than 6 mm by 3 mm (0.24 inches by 0.11 inches).

The basket portion 55, preferably, is formed of any metal such as copper, steel, stainless steel or aluminum, and the like. The basket portion 55 includes a bottom wall 56, a pair of spaced apart sidewalls 58 and 60, and another pair of sidewalls 62. Preferably, the sidewalls 58, 60 and 62 are joined together to form closed curved corners 64. The sidewalls 58, 60 and 62 extend upwardly from the bottom wall 56 to form an upwardly-facing opening 66.

Figure 3:
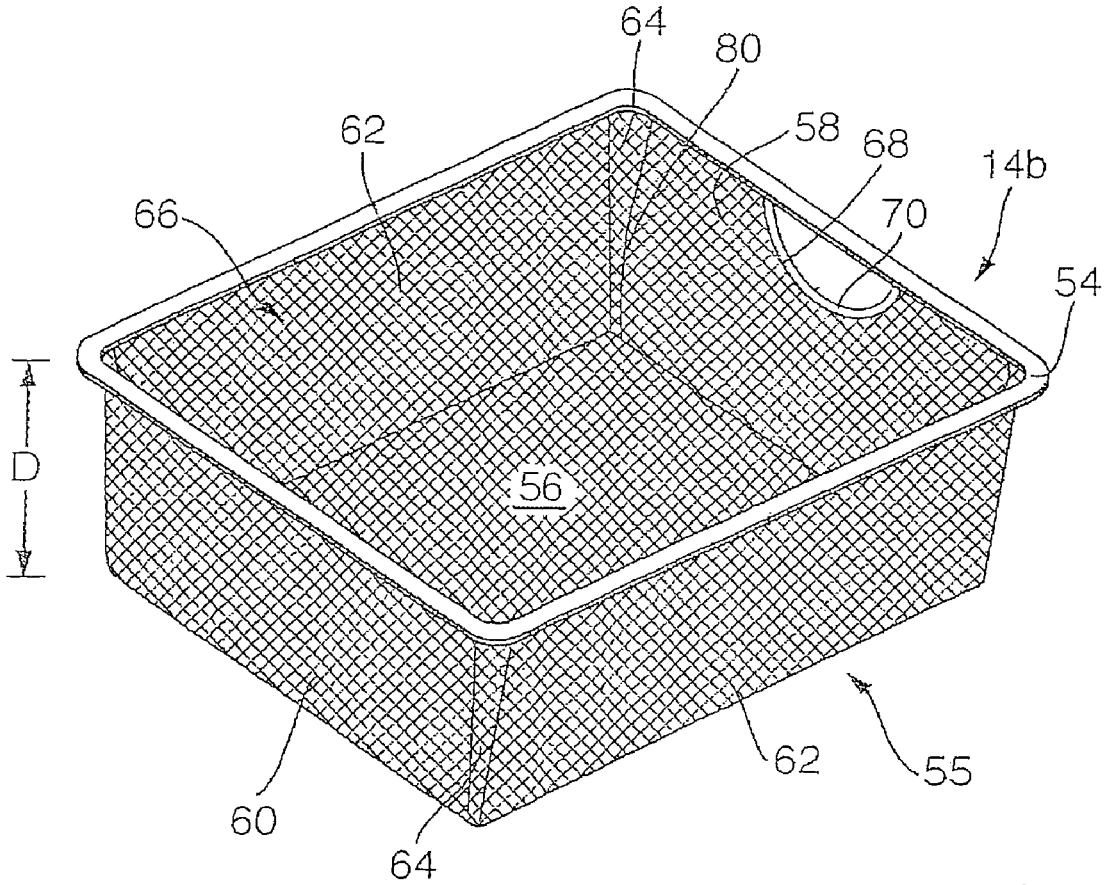
FIG. 3 is an enlarged, rear, perspective view of a first preferred embodiment of a drawer shown in FIG. 1.
Figure 3A:
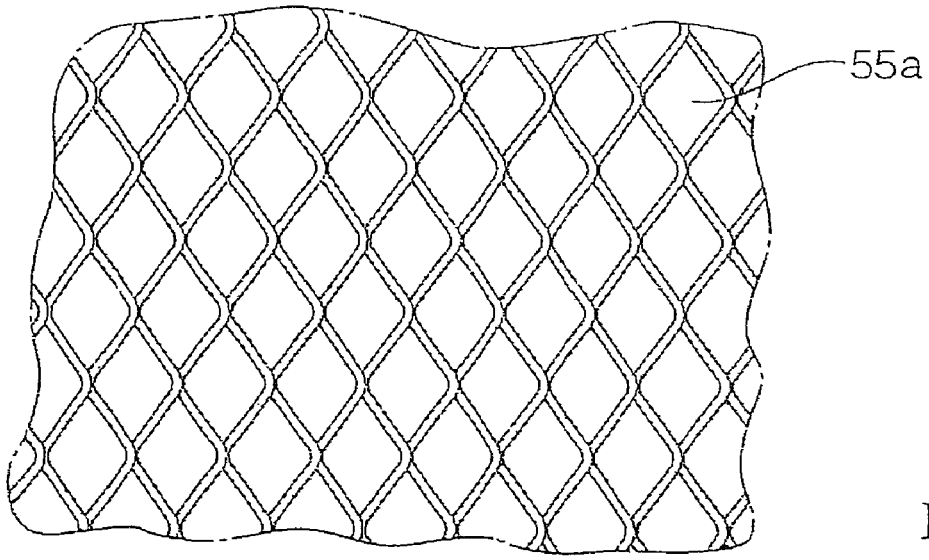
FIG. 3A is an enlarged, perspective view of a portion of the drawer shown in FIG. 3.

As shown in FIG. 3, the corners 64 are curved so that they deviate from straightness in a smooth, continuous fashion. The present invention, however, is not limited to drawers with curved corners and drawers with more angular corners are also considered inventive. The present invention is also not limited to drawers with a radius of curvature greater at the top of the drawer (adjacent the rail 54) than at the bottom. Thus, drawers with, for example, a constant radius of curvature are also considered inventive.

In this embodiment, the sidewall 58 forms a front end wall that includes a curved cutout 68 bordered by a handle rail 70. The cutout 68 forms a place where a user can easily grasp the drawer 14*b* to move it between the retracted and extended positions. In an alternative embodiment, the cutout 68 can be replaced with other methods to aid the user in moving the drawer 14*b*, such as a protruding handle connected to wall 58. The handle rail 70 may have a circular cross-sectional shape and be cut and formed to extend along the edge of cutout 68. Preferably, the rail 70 is of the same material as upper rail 54 and is spot-welded to the basket portion 55. In this embodiment, the sidewall 60 forms a rear end wall.

Figure 4:
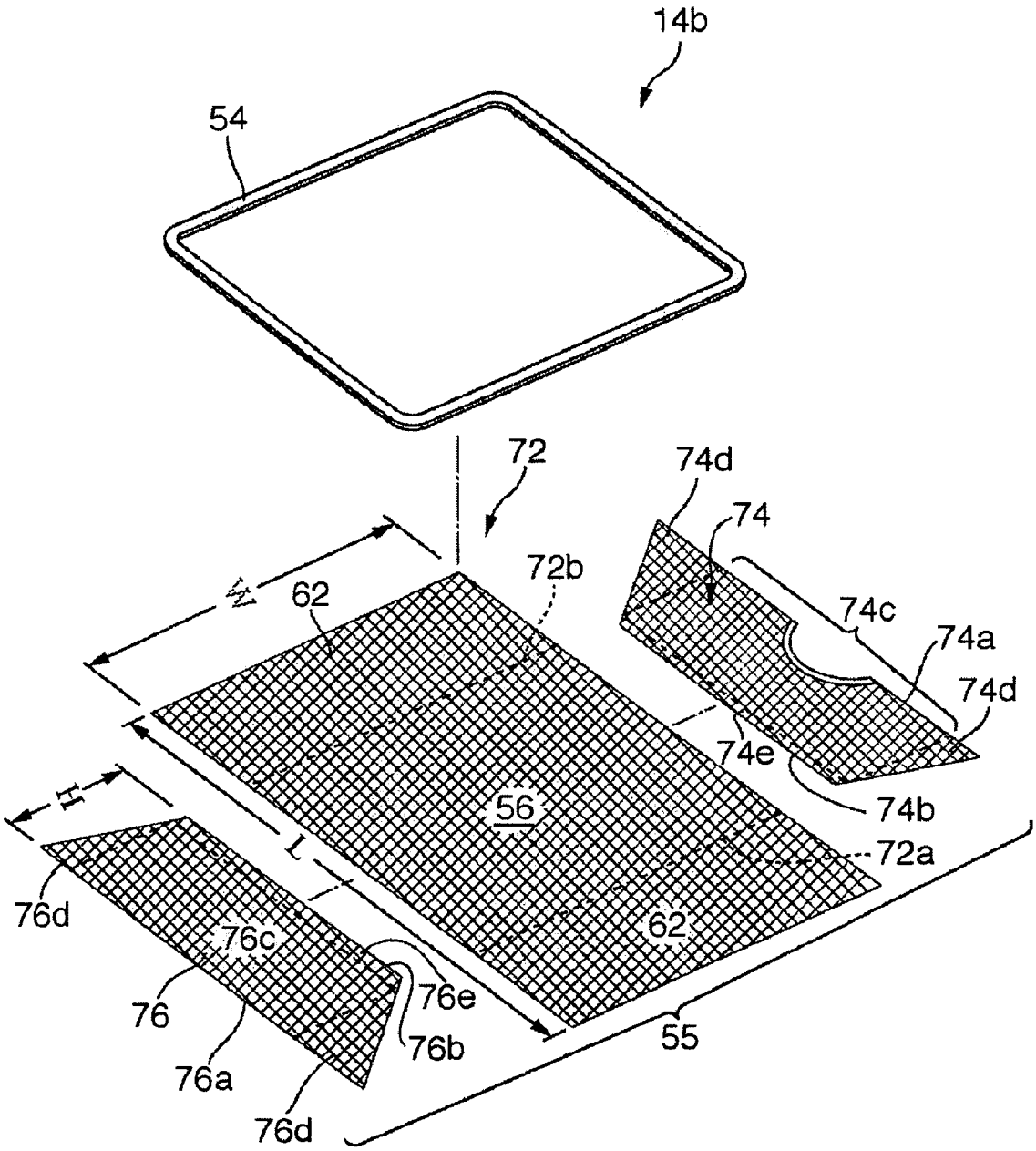
FIG. 4 is an exploded, rear, perspective view of the drawer shown in FIG. 3.
Figure 5:
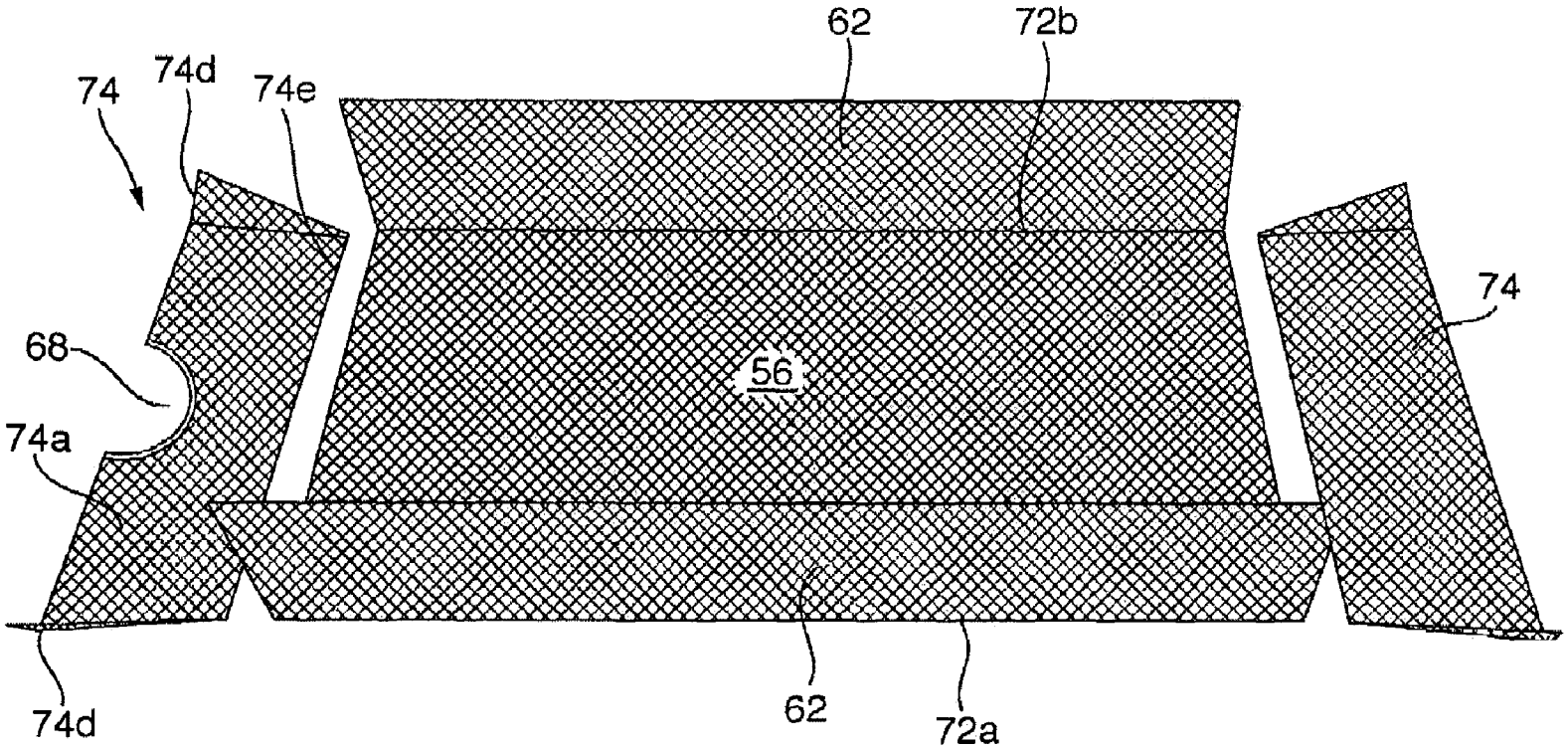
FIG. 5 is an exploded, rear, perspective view of a portion of the drawer shown in FIG. 3, wherein all of the mesh pieces have been bent.

Referring to FIG. 4, the drawer 14*b* is shown in a disassembled state. The basket portion 55 is formed by a first piece of mesh 72, a second piece of mesh 74 and a third piece of mesh 76. The first, second, and third pieces of mesh are formed separately from one another. The first piece of mesh 72 is bent along lines 72*a,b* to form edges as shown in FIG. 5 to define bottom wall 56 and sidewalls 62. The angle between the bottom wall 56 and sidewalls 62 is greater than about 90°, but the present invention is not limited to this configuration.

The second piece of mesh 74 includes an outer edge 74*a*, an inner edge 74*b*, a central portion 74*c*, side extensions 74*d*, and a lower extension 74*e*. The central portion 74*c* is between the outer edge 74*a* and the lower extension 74*e* and between the side extensions 74*d*. The side extensions 74*d* have a trapezoidal shape so that they taper downward from the outer edge 74*a* to the lower edge 74*b*. The second piece of mesh 74 is bent to form front end wall 58, curved corners 64, and lower extension 74*e* that is generally perpendicular to front end wall 58 (see FIGS. 3 and 5). Third piece of mesh 76 is formed similarly to second piece of mesh 74 to include an upper edge 76*a*, a lower edge 76*b*, a central portion 76*c*, side extensions 76*d*, and a lower extension 76*e*.

In an alternative embodiment, the pieces of mesh 74 and 76 can be formed of a single piece of material separate from the first piece of mesh 72. In such event, the two pieces of mesh 74 and 76 would be joined by another mesh segment (not shown) that would be shaped similar to bottom wall portion 56. As a result, the bottom wall of basket 55 would be formed of two layers of mesh material that overlap.

Figure 5A:
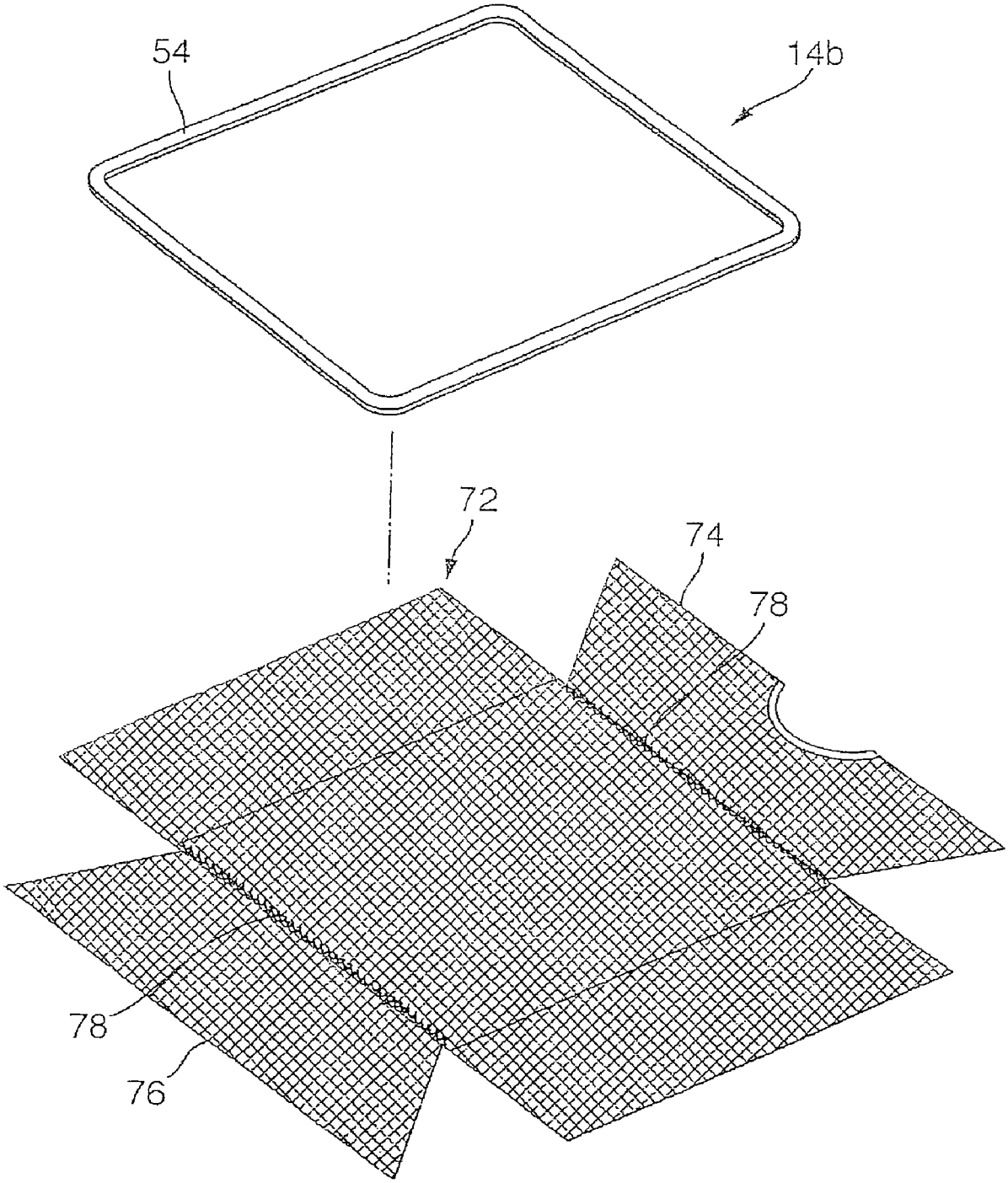
FIG. 5A is a partially-exploded, rear, perspective view of the drawer shown in FIG. 4, wherein three pieces of mesh material have been joined together.

Referring to FIG. 5A, the first, second, and third pieces of mesh 72, 74, and 76 have been joined together so that bottom seams 78 are formed. Seams 78 are where the material of bottom wall 56 of the first piece of mesh 72 overlaps with lower extension 74*e* of the second and third pieces of mesh 74 and 76 (see FIG. 4). When the corners 64 are formed, side seams 80 (as shown in FIG. 3) are formed adjacent each corner 64. Seams 80 are where the material of sidewalls 62 of the first piece of mesh 72 overlaps with side extensions 74*d* and 76*d* of second and third pieces of mesh 74 and 76, respectively. Seams 80 are generally vertically extending side seams.

The method of making drawer 14*b* will now be discussed. Referring to FIGS. 4 and 5, the first piece of mesh 72 is formed shaped as shown. This involves cutting a piece of mesh 72 with the desired dimensions from a roll of mesh using a conventional press machine. Then, the first piece of mesh 72 is bent into a U-shape that includes the bottom wall 56 and end walls 62 (as shown in FIG. 5). A conventional hydraulic press machine is used to bend the mesh piece 72. The hydraulic press machine includes a mold for achieving the desired bent shape, as is known by those of ordinary skill in the art.

The second and third pieces of mesh 74 and 76 are formed and shaped as shown in FIG. 4. This involves cutting the pieces of mesh 74 and 76 with the desired dimensions and shape from a roll of mesh using a conventional press machine. Then, the piece 74 is bent using a conventional hydraulic press machine so that side extensions 74*d* are curved and lower extension 74*e* is angularly offset from center section 74*c*. The hydraulic press machine includes a mold, as is known by those of ordinary skill in the art. The third piece of mesh 76 is bent similarly to second piece 74 (as shown in FIG. 5). The handle rail 70 may be welded to mesh piece 74 at this point or later, when the upper rail 54 is joined to basket portion 55.

After the drawer 14*b* is completely formed, optionally but preferably a process of powder painting may be used to coat the drawer 14*b*, as is known by those of ordinary skill in the art. One preferable paint is an epoxy coat. The painting may provide a decorative (colored and/or metallic) finish to the drawer 14*b*, if desired, and will also provide some protection for the drawer 14*b* from water and other corrosive elements.

Next, the lower extensions 74*e*,76*e* of each piece 74,76 are connected by welding to the side edge of the bottom wall 56 of first piece 72 (as shown in FIG. 5A) to form seams 78. Then, the curved side extensions 74*d*,76*d* of pieces 74,76 are connected by welding to sidewalls 62 of first piece 72 to form seams 80 (as shown in FIG. 3).

Figure 6:
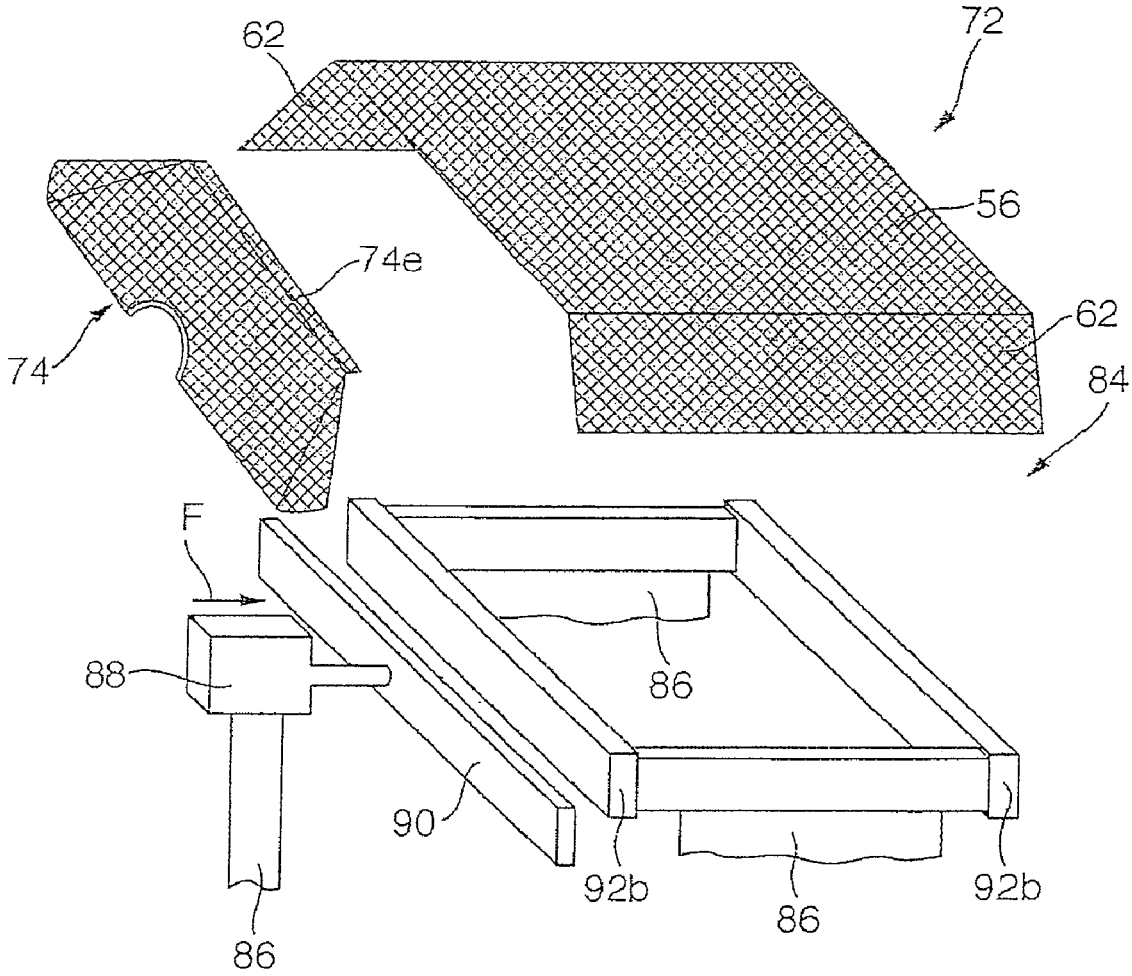
FIG. 6 is a schematic representation of some of the mesh pieces of FIG. 5 and a portion of a welding machine for joining such pieces.
Figure 7:
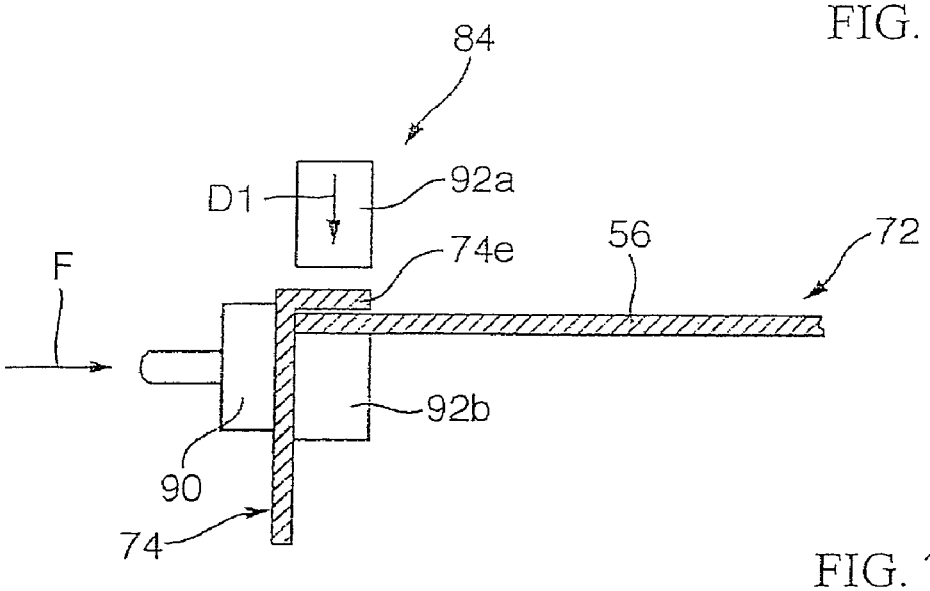
FIG. 7 is a schematic representation of some of the mesh pieces of FIG. 5 and another portion of the welding machine of FIG. 6.

Referring to FIGS. 5, 6, and 7, the equipment used to connect the first, second and third pieces of mesh 72, 74, and 76 together will now be discussed. The equipment preferably comprises a spot-welding machine 84 including a base 86, a clamp 88 supported on the base 86, a movable elongated member 90 movable by the clamp 88 to provide a clamping force F, and a pair of anode electrodes 92*a* and a pair of cathode electrodes 92*b*. The base 86, clamp 88, member 90, and cathode electrodes 92*b* form a fixture for supporting the mesh pieces 72, 74, and 76 during welding. As shown, preferably, the cathode electrodes 92*b* are preferably bar-like and parallel to one another to properly support and clamp mesh pieces 72, 74, and 76. In an alternative embodiment, the spot-welder can be used without the clamp 88 and elongated member 90, where the pieces may be manually held during welding.

In order to join lower extension 74*e* of second piece 74 to bottom wall 56 of first piece 72, the already-bent first piece 72 is disposed on cathode electrodes 92*b* so that the sidewalls 62 extend downward (as shown in FIG. 6) toward the floor. Bent second piece 74 is disposed between member 90 and cathode electrode 92*b*, as shown in FIG. 7. Next, the clamp 88 is actuated so that the clamping force F moves the member 90 from a retracted position (shown in FIG. 6) into a clamping position (shown in FIG. 7). In the clamping position, the mesh piece 74 is compressed between member 90 and cathode electrode 92*b*. The clamping force F must be sufficient to hold mesh piece 74 into contact with mesh piece 72 for the welding operation.

Then, the anode electrode 92*a* moves in direction D1 into contact with pieces 72,74 adjacent extension 74*e*. These pieces 72,74 are tightly compressed between the electrodes 92*a* and 92*b*. The electrodes 92*a*,*b* then discharge electric welding current through the place to be welded and seam 78 (see FIG. 5A) is formed. The third piece 76, as shown in FIG. 5, is similarly joined to first piece 72. Preferably, the welding machine 84 is properly configured so that the fixture includes two clamps, two elongated members 90 and two pairs of electrodes 92*a*,*b*. As a result, the second and third pieces 74 and 76 can preferably be simultaneously welded to first piece 72.

Another spot-welding machine similar to machine 84 is used to weld pieces 74 and 76 to piece 72 adjacent the corners 64 to form seams 80. This spot-welding machine for forming seams 80 has an appropriately sized fixture including clamp(s), elongated member(s) and cathode electrode(s) for smaller pieces 74 and 76. For example, the cathode electrode(s) may be tapered to match trapezoidal extensions 74*d*,76*d* so that pieces 74 and 76 are suitably clamped to end walls 58 and 60 during welding.

Figure 8:
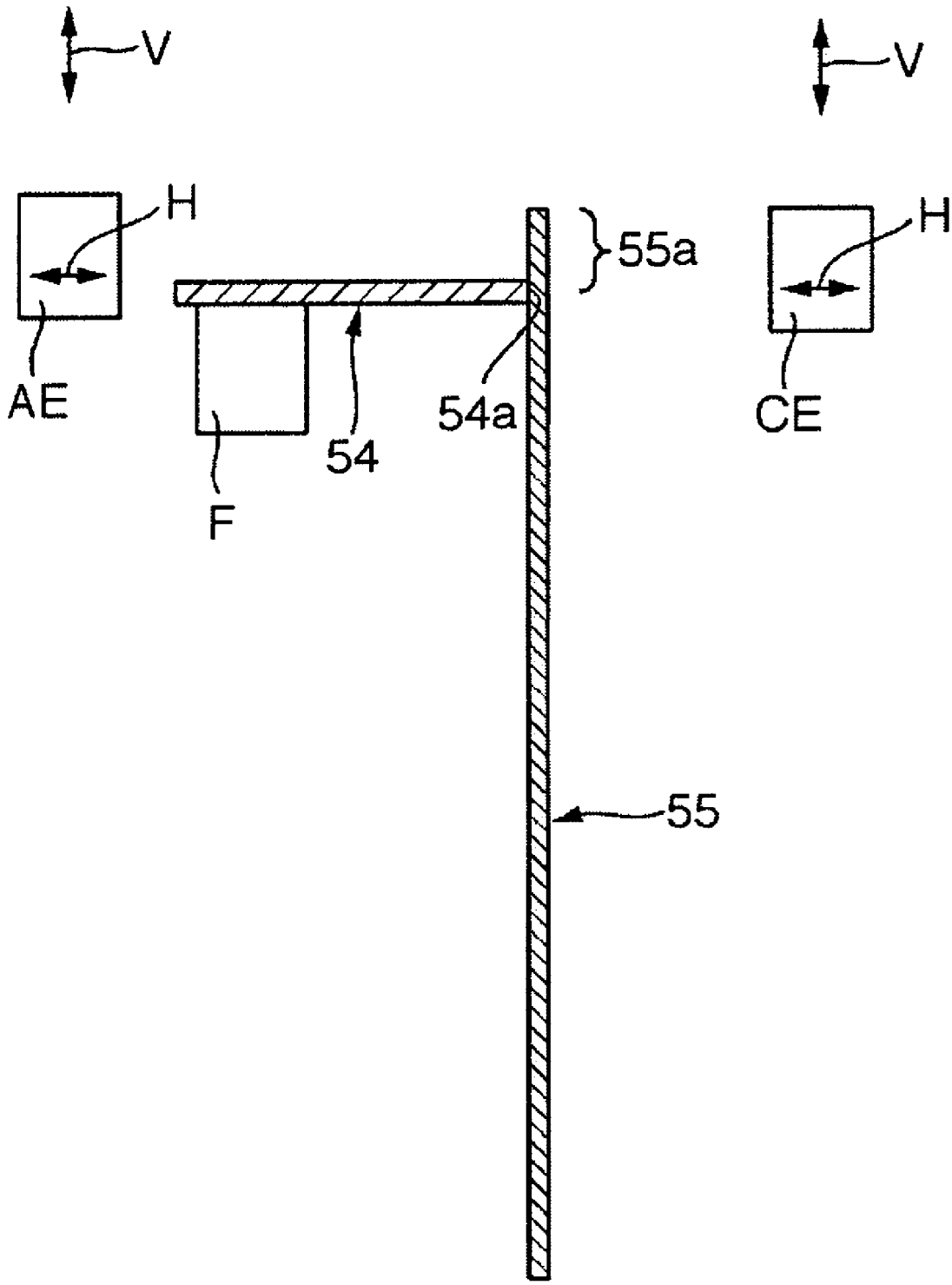
FIG. 8 is a partial, elevational view of a first embodiment of an upper rail joined to one of the mesh pieces shown in FIG. 5, wherein an upper portion of the mesh piece is uncropped.
Figure 9:
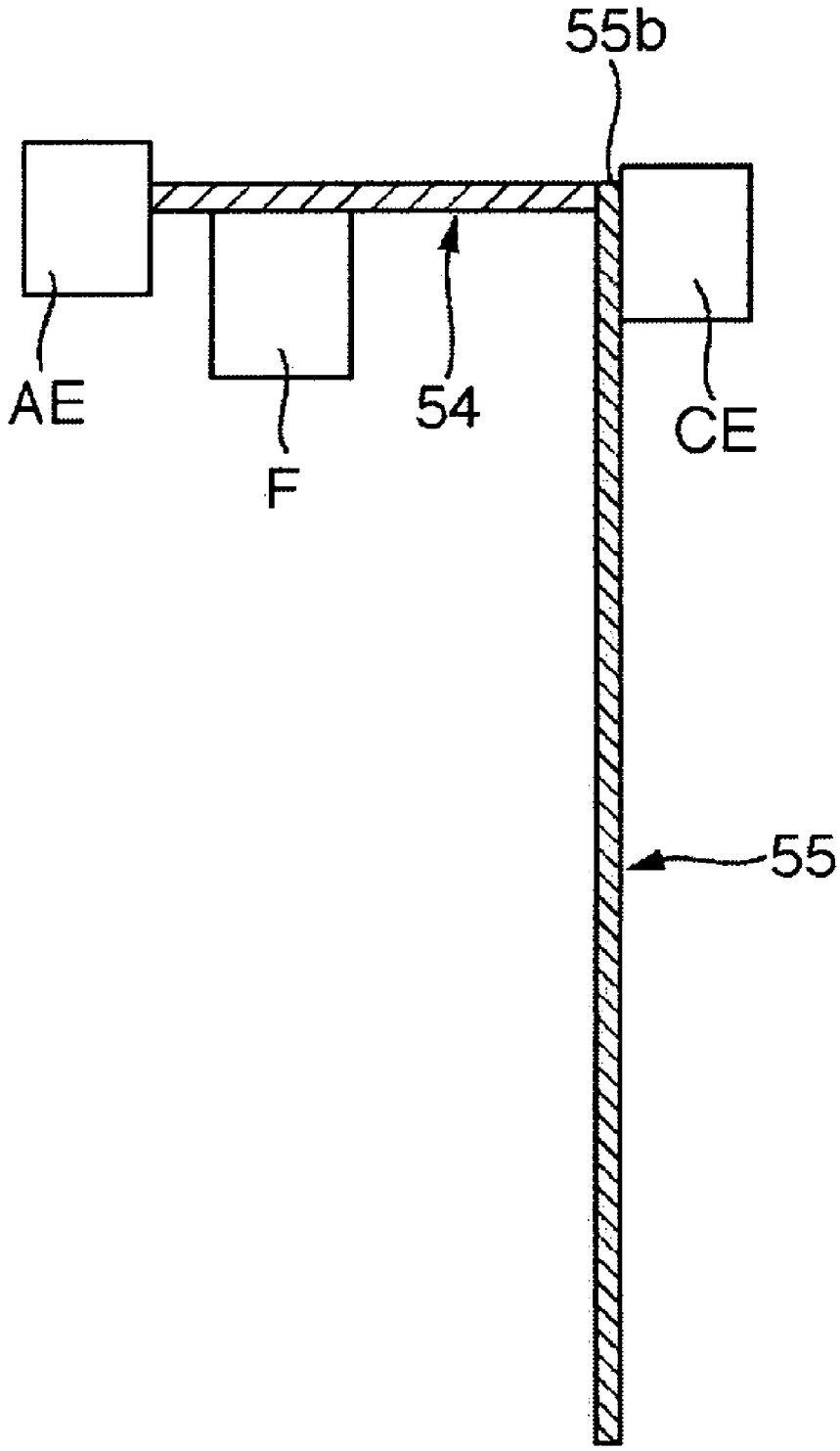
FIG. 9 is a partial, elevational view of the upper rail joined to the mesh piece of FIG. 8, wherein the upper portion of the mesh piece is cropped.

With reference to FIG. 3, the upper rail 54 is subsequently connected to the upper section of the end walls 58 and 60 and sidewalls 62 by spot-welding. Referring to FIGS. 3 and 8-9, the step of connecting the upper rail 54 to the basket portion 55 further preferably includes the steps of forming a generally flat upper rail 54; contacting rail 54 to basket portion 55 on a contact surface 54*a* so that an upper section 55*a* of the basket portion 55 extends above the rail 54; and spot-welding the contact surface 54*a* to the outer surface of basket portion 55.

The upper rail 54 is preferably formed of the same material as the basket portion 55 so that these components can be welded together. Thus, preferably, the rail 54 is formed of any metal such as copper, steel, stainless steel, mild sheet steel or aluminum, and the like. In a preferred embodiment using sheet steel, a roll of sheet steel strip material with a circular cross-section is used. This material is passed through a conventional roll forming machine with a number of pairs of rollers using a predetermined compression pressure to continuously and gradually change the circular cross-section into a generally flat rectangular cross-section, as is known by those of ordinary skill in the art.

The material with the flat rectangular cross-section is then fed into a bending machine that includes spaced apart pairs of guide rollers for guiding the material through the machine and bending the material into four spaced apart right angles to form a rectangular ring. Hydraulic power can be used to provide the bending force to the associated pairs of guide rollers. Where the bending pairs of guide rollers are located, the machine further includes rollers for preventing vertical expansion of the material. Once the rectangular ring is formed, the free ends of the ring are joined by welding to form the upper rail 54.

The rail is not limited to the above configuration, shape and materials. For example, it can be hollow with various shapes, such as a circular cross-section. The rail can also be solid with various shapes, such as a circular cross-section. The rail can also be formed of a plastic that is connected to the basket portion 55 by glue or adhesive, for example.

Referring to FIGS. 8 and 9, the step of contacting rail 54 to basket portion 55 on a contact surface 54*a* may preferably further include the step of using a spot-welding machine with a fixture F for supporting the rail 54 at a sufficient elevation above a table (not shown) so that the upper section 55*a* of the basket portion 55 extends above the rail 54. The fixture F may also provide a clamping force for assuring the surface 54*a* is in solid contact with the basket portion 55 or this force may be provided by movable anode and cathode electrodes AE and CE, respectively. Preferably, electrodes AE and CE are circular welding wheels. The anode electrode AE contacts the outer surface of the rail 54 and the cathode electrode CE contacts the inner surface of the basket portion 55 adjacent surface 54*a*, as shown in FIG. 9. An electric current is discharged through the electrodes AE and CE, rail 54 and basket portion 55 to spot-weld the rail 54 to the basket portion 55. Preferably, sufficient electrodes AE and CE are provided to make the welding of rail 54 to basket portion 55 efficient. Since the electrodes AE and CE are movable vertically in directions V and horizontally in directions H, the spot-welder can be used to weld variously size rails and baskets together.

The step of connecting the upper rail 54 may further include cutting and grinding steps. In the cutting step, the upper section 55*a* (as shown in FIG. 8) of basket portion 55 is severed using a conventional severing apparatus, such as one including a reciprocating saw blade. In the grinding step, the exposed upper edge 55*b* (FIG. 9) of basket portion 55 is worked using a conventional grinding machine so that a smooth upper edge 55*b* is formed. The rail 54 aids in providing structural rigidity to the basket portion 55 and is the only rail circumscribing each drawer's perimeter.

Referring to FIGS. 1 and 3, in use the drawer 14*b* is inserted into the system 10 by disposing upper rail 54 within gap 28 of opposed, aligned pair of runners 26*b*. The rail 54 and gap 28 are sized to allow free sliding movement of the drawer 14*b* with respect to the frame 12 between the retracted and extended positions.

Since the drawer 14*b* is formed of mesh with very small openings 55*a* (see FIG. 3), small objects, such as pens, paper clips, and the like, can be stored in the drawer without a liner and will not fall through the openings 55*a*. In addition, since the drawer 14*b* has closed corners 64, small objects also cannot fall out of this area of the drawer.

As shown in FIG. 1, drawers 14*b*-14*d* are of medium size and vertically extend across two sets of vertically spaced runners. Drawer 14*a* is a small size and consequently extends across only one set of vertically spaced runners. The drawers may be sized differently, see FIG. 4, particularly by changing the length L of the first piece of mesh 72 and the height H of the second and third pieces of mesh 74 and 76. This allows containers of a variety of sizes to be formed without excess machinery costs, particularly large containers having a depth D from bottom wall 56 to top surface of top rail 54 (see FIG. 3) equal to or greater than about 11 inches. If larger baskets are desired, the basket material may need to be changed and/or thickened to provide more rigidity thereto. The width W of the mesh (FIG. 4) can be set by the machine forming the raw material so that the edges of piece 72 that will be connected to pieces 74 and 76 are smooth and require no cutting or grinding.

Figure 10:
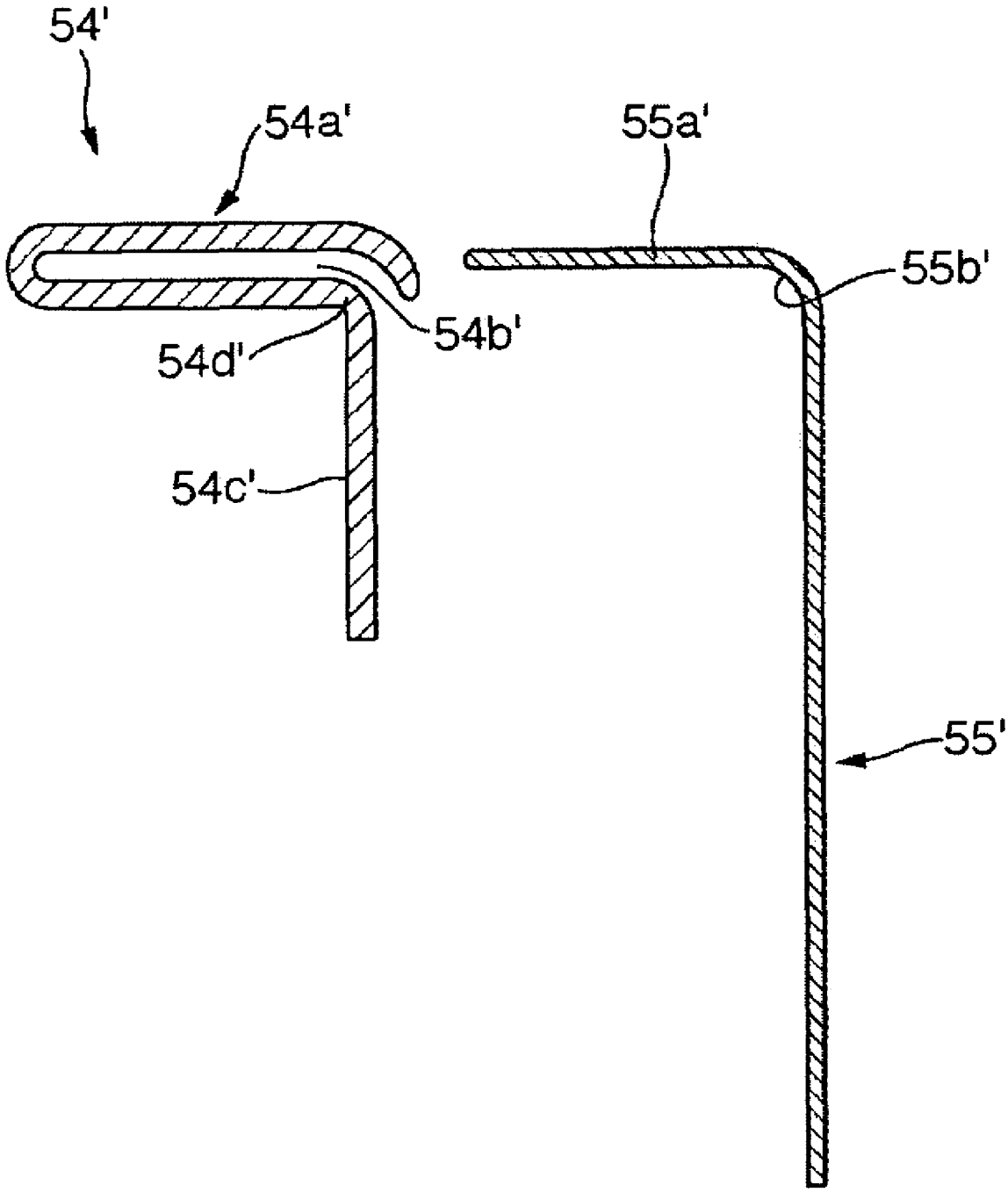
FIG. 10 is a partial, elevational view of a second embodiment of an upper rail separated from a mesh piece.
Figure 11:
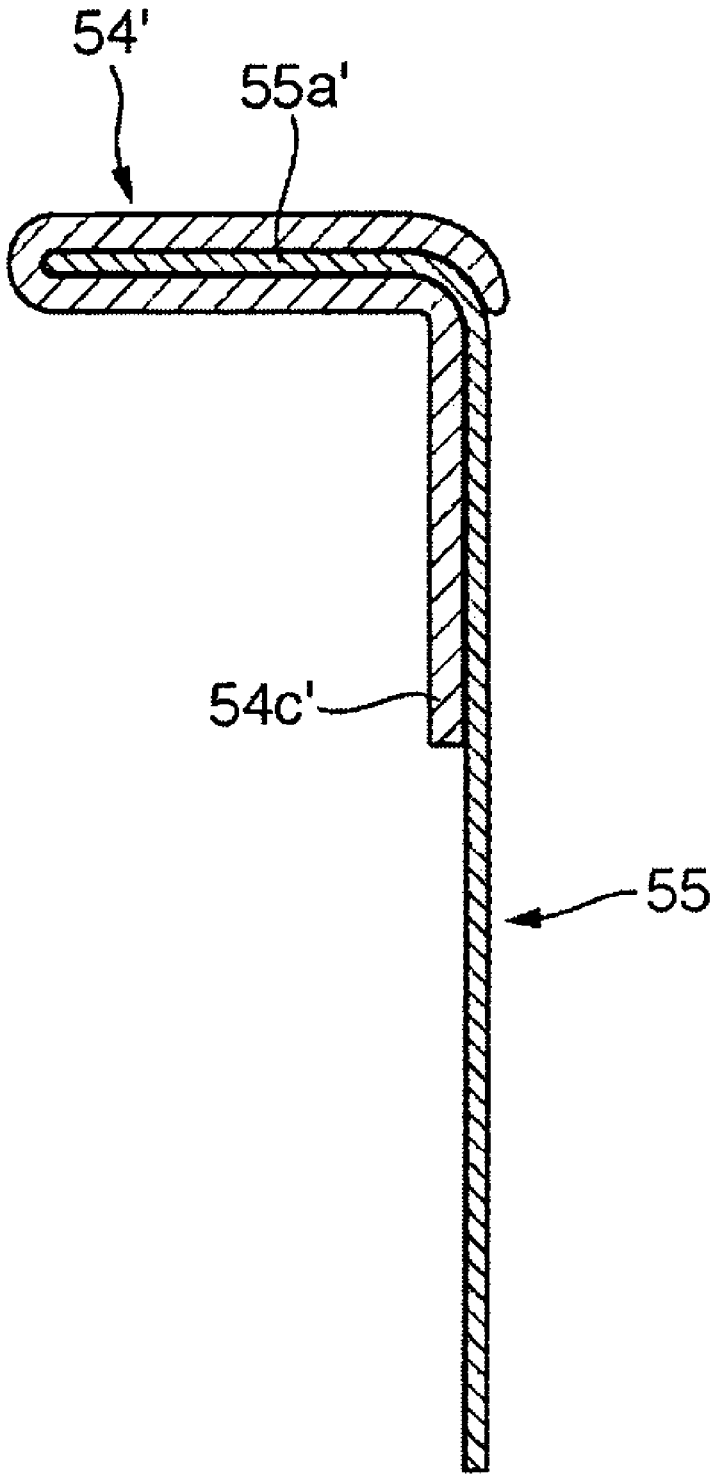
FIG. 11 is a partial, elevational view of the upper rail joined to the mesh piece of FIG. 10.
Figure 12:
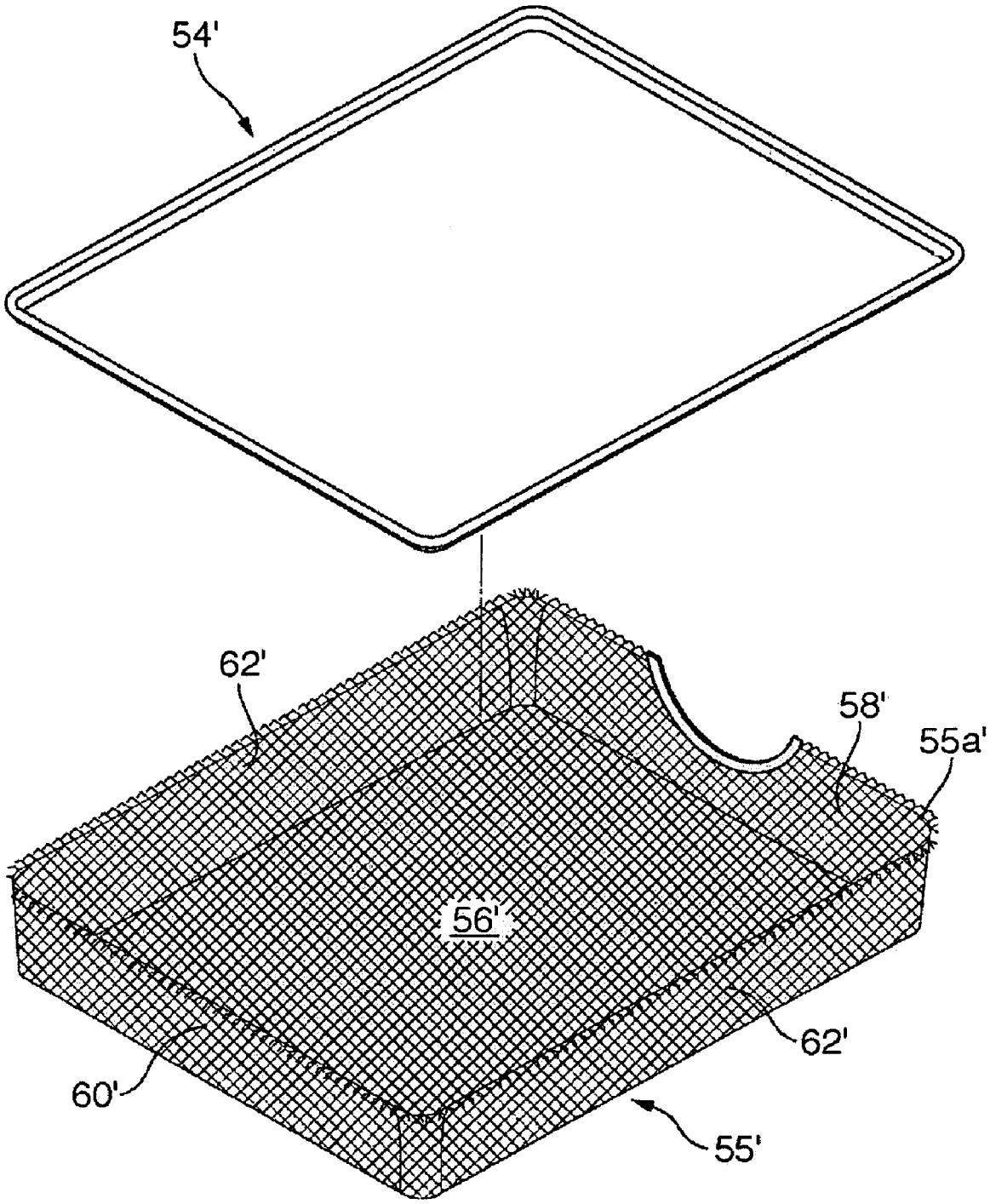
FIG. 12 is an exploded, rear, perspective view of a second embodiment of a basket using the upper rail and mesh piece shown in FIGS. 10 and 11.

FIGS. 10-12 illustrate an alternative embodiment of the upper rail 54' for use with an alternative embodiment of basket portion 55'. To form the upper rail 54' raw material is bent to include a curved portion 54*a*' with an opening 54*b*' and an extension 54*c*' angularly offset from curved portion 54*a*' using a roll forming machine. The material is bent into a closed rectangular loop and welded together, similar to rail 54.

The basket portion 55' is formed similarly to basket portion 55 except the end walls 58, 60 and sidewalls 62 all have an outwardly bent upper section 55*a*' formed by a conventional hydraulic press machine with a mold at the same time other bends are formed in pieces 72, 74, 76 (see FIG. 5).

The bent upper section 55*a*' is inserted into the opening 54*b*' of the upper rail 54' (as shown in FIG. 11). The curved portion 54*a*' is then compressed by a conventional press machine so that the opening 54*b*' is minimized and curved portion 54*a*' tightly engages the basket portion 55*a*'. This step also results in the front curved tip 54*d*' of the rail 54' engaging the angled corner 55*b*' of the basket portion 55'. Then, the vertically-extending extension 54*c*' is welded to the basket using a spot-welding machine and fixture similar to the method used for rail 54 (shown in FIGS. 8 and 9). Once the upper rail 54' is joined to basket portion 55' in this manner, it provides additional structural rigidity to the basket portion 55'. Using the rail 54' eliminates the need to cut the upper section 55*a* of basket portion 55 as when using rail 54, as shown in FIGS. 8 and 9. Consequently, rail 54' eliminates the need to deburr the basket portion 55'.

Referring back to FIG. 1, basket 14*a* includes a rectangular cutout 68' on the front of wall 58'. A metal handle rail 70' covers the free end of the mesh within the cutout 68'. The handle rail 70' is preferably formed similar to rail 54' with an opening that is compressed about the mesh, once the mesh is inserted therein. Preferably, the handle rail 70' also includes an extension, similar to extension 54*c*' of rail 54', that can be spot-welded to securely attach the rail 70' to the mesh. In such an embodiment, the opening in the rail 70' extends vertically along with the extension. In an embodiment of the handle rail 70' without such an extension, the rail 70' may still be spot-welded to the mesh.

Figure 13:
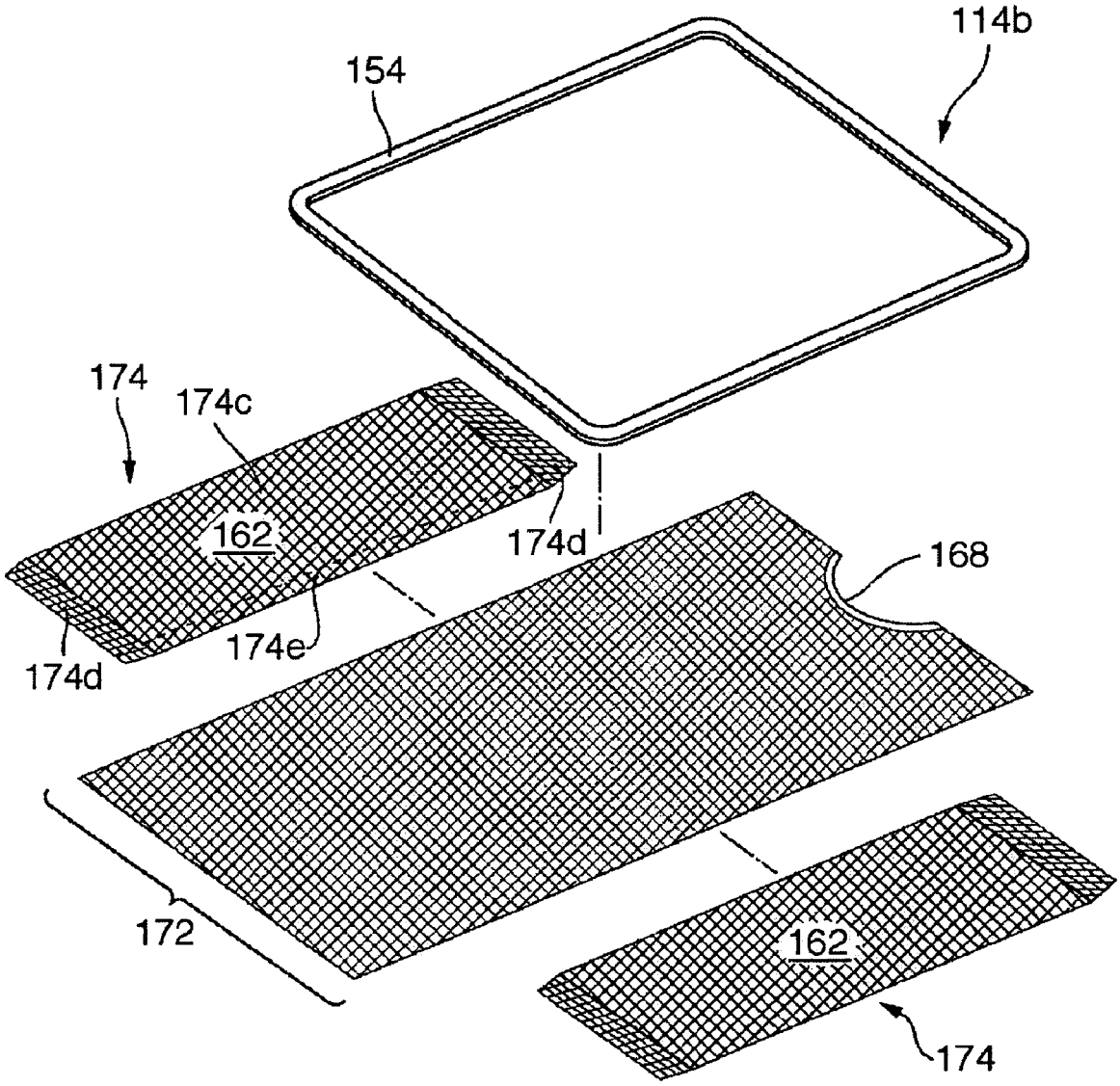
FIG. 13 is an exploded, rear, perspective view of a third embodiment of a drawer for use in the system of FIG. 1, wherein an alternative embodiment of two side pieces of mesh material are used.
Figure 14:
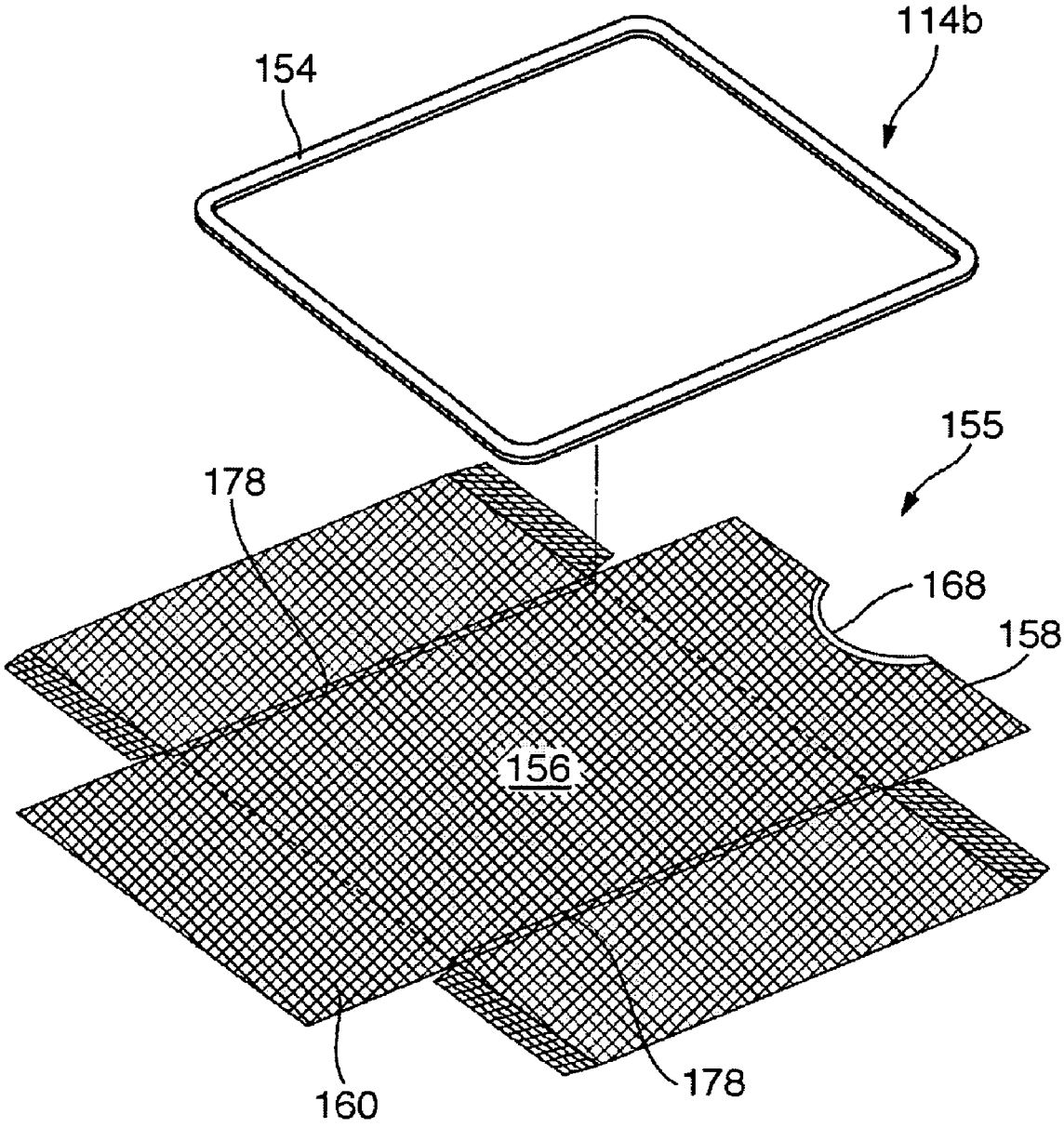
FIG. 14 is a partially-exploded, rear, perspective view of the drawer shown in FIG. 13, wherein three pieces of mesh material have been joined together.

Referring to FIGS. 13-14, a third preferred drawer embodiment 114*b* is shown. Drawer 114*b* comprises a runner portion or upper rail 154 and a basket portion 155. The upper rail 154 may be formed like rail 54 or rail 54' previously discussed. The basket portion 155 includes a bottom wall 156, end walls 158 and 160, and sidewalls 162. The bottom and end walls 156 and 158 are also sidewalls. A first piece of mesh 172 is bent to form the bottom wall 156 and end walls 158 and 160. The sidewalls 162 are formed of separate second and third pieces of mesh 174 and 176, respectively. The end wall 158 includes a first piece of mesh 172 with a cutout 168 similar to end wall 58.

For drawer 114*b*, different from drawer 14*b*, the second piece of mesh 174 includes a central portion 174*c*, rectangular side extensions 174*d* and a lower extension 174*e*. The third piece of mesh 176 has a similar configuration. When the pieces 172, 174 and 176 are connected using a method similar to that used in forming drawer 14*b*, the drawer 114*b* has closed smoothly curved corners similar to corners 64 (as shown in FIG. 3), but the corners of drawer 114*b* will have a substantially constant radius. Drawer 114*b* also includes four side seams 80 at each corner and two bottom seams 178.

Figure 15:
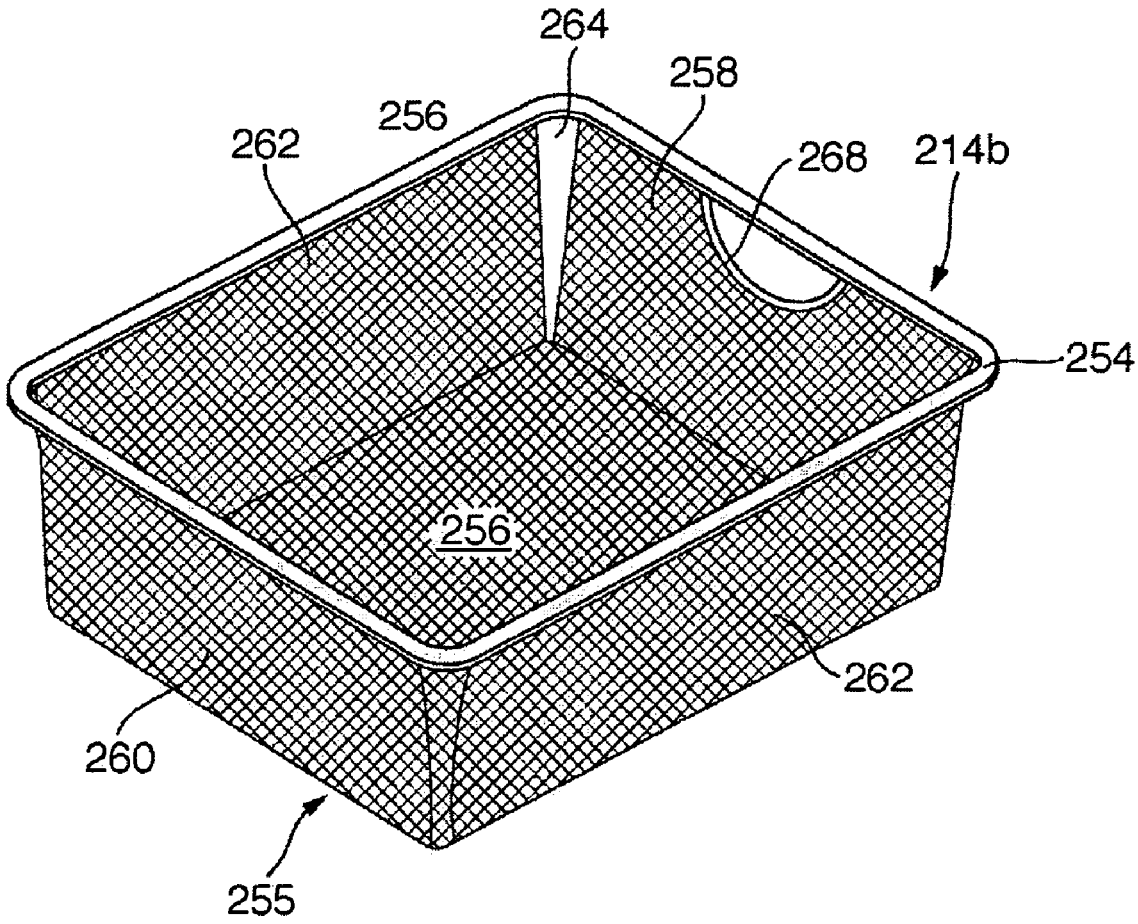
FIG. 15 is an enlarged, rear, perspective view of a fourth embodiment of a drawer useful in the system of FIG. 1.
Figure 16:
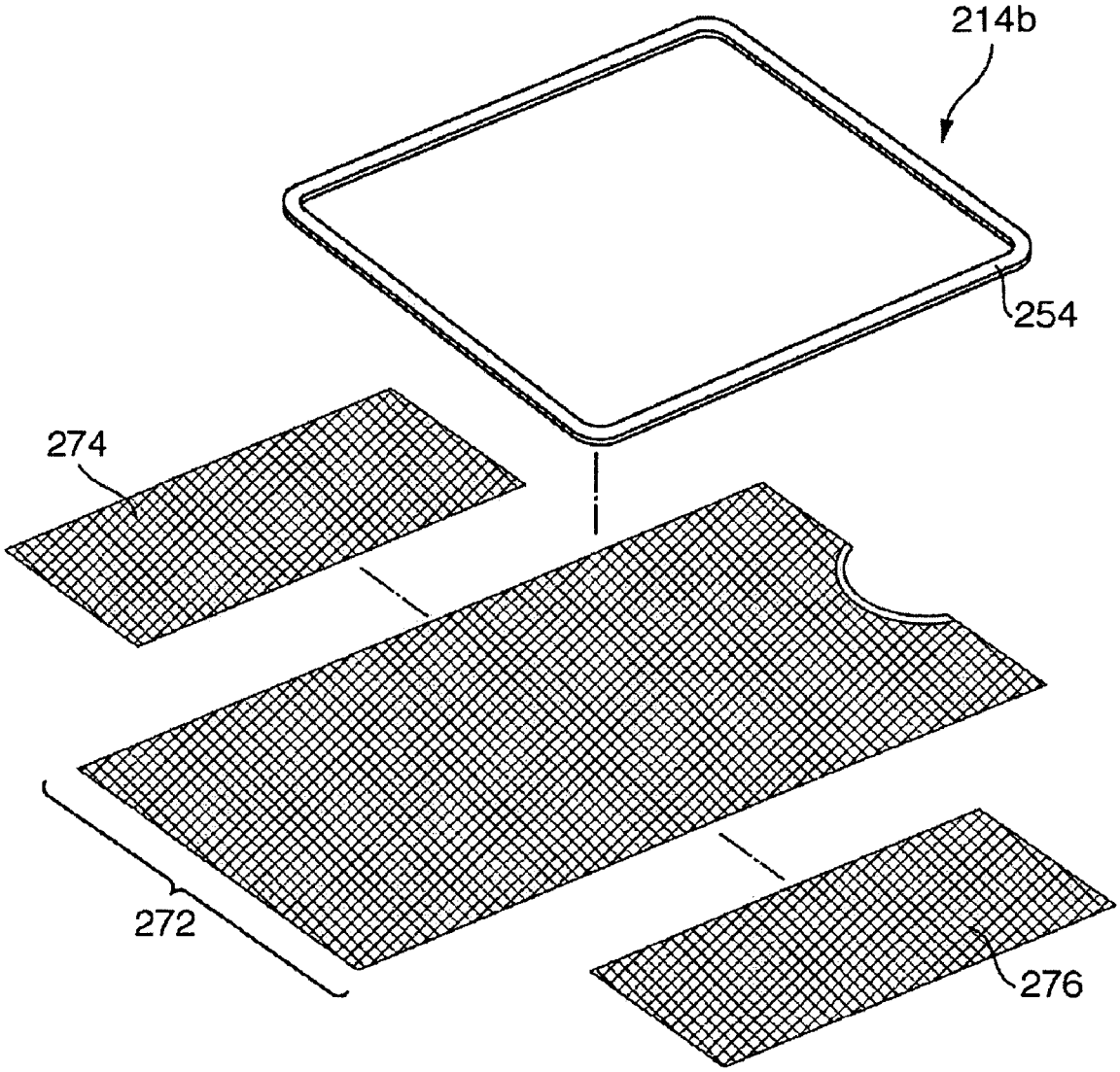
FIG. 16 is an exploded, rear, perspective view of the drawer shown in FIG. 15.
Figure 17:
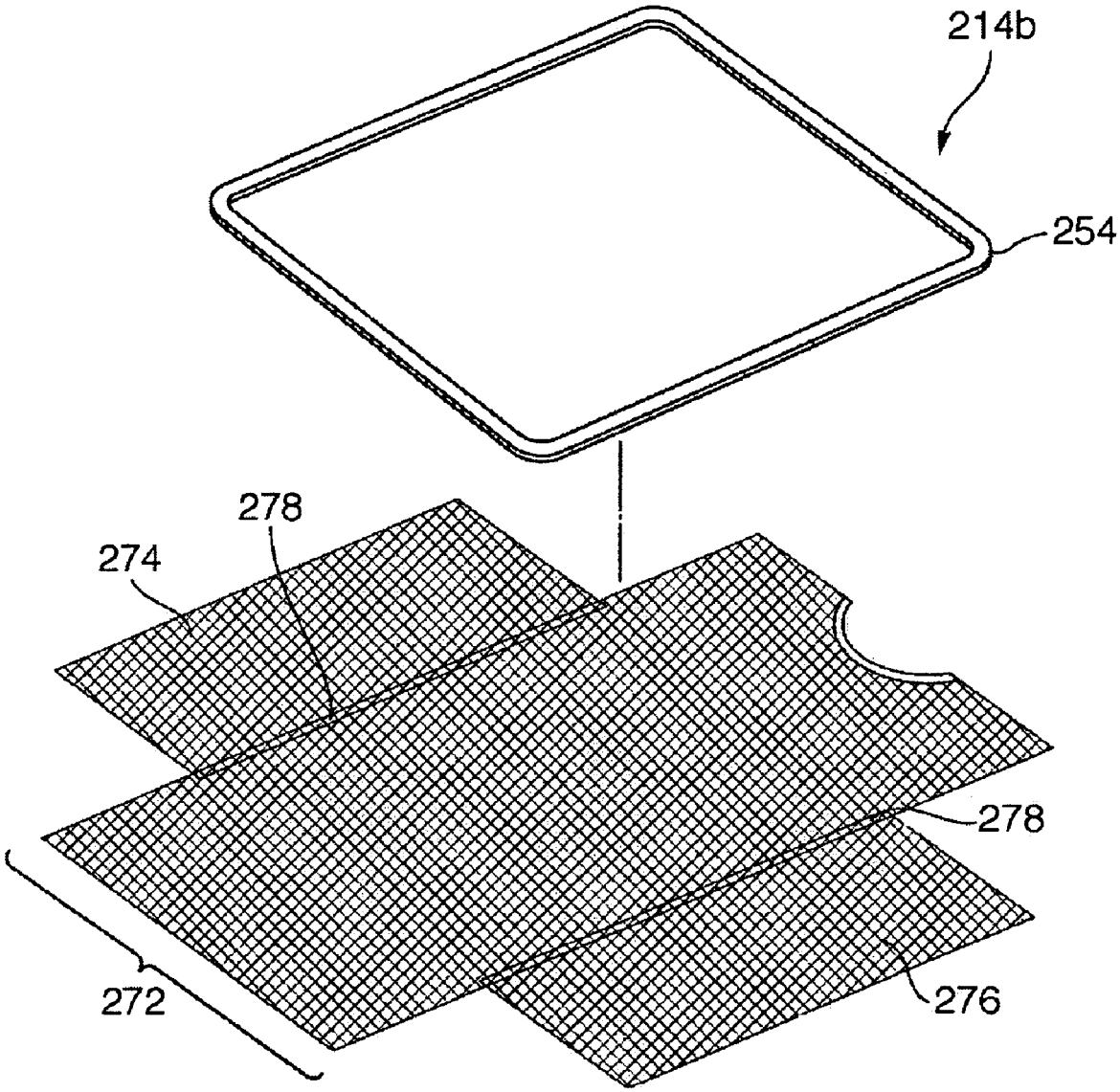
FIG. 17 is a partially-exploded, rear, perspective view of the drawer shown in FIG. 15, wherein three pieces of mesh material have been joined together.

Referring to FIGS. 15-17, a fourth preferred drawer embodiment 214*b* is shown. Drawer 214*b* comprises a runner portion or upper rail 254 and a basket portion 255. The upper rail 254 may be formed like rail 54 or rail 54' discussed above. The basket portion 255 includes a bottom wall 256, end walls 258 and 260, and sidewalls 262. The end walls 258 and 260 are also sidewalls. A first piece of mesh 272 is bent to form the bottom wall 256 and end walls 258 and 260. The sidewalls 262 are formed of separate second and third pieces of mesh 274 and 276. The end wall 258 includes a cutout 268 similar to end wall 58.

In drawer 214*b*, different from drawers 14*b* and 114*b*, the second and third pieces of mesh 274 and 276 do not include extensions. When the pieces 272, 274 and 276 are connected using the method of forming drawer 14*b*, pieces 274 and 276 only overlap piece 272 on the bottom not on the sides. As a result, the drawer 214*b* has open corners 264 (as shown in FIG. 15) and two bottom seams 278. Drawers configured like drawer 214*b* can be used in systems like system 10 (shown in FIG. 1) and move between extended and retracted positions. Drawers similar to drawer 214*b* can come in a number of sizes. The drawer 214*b* is formed similarly to drawer 14*b* by bending and spot-welding the mesh pieces.

Figure 18:
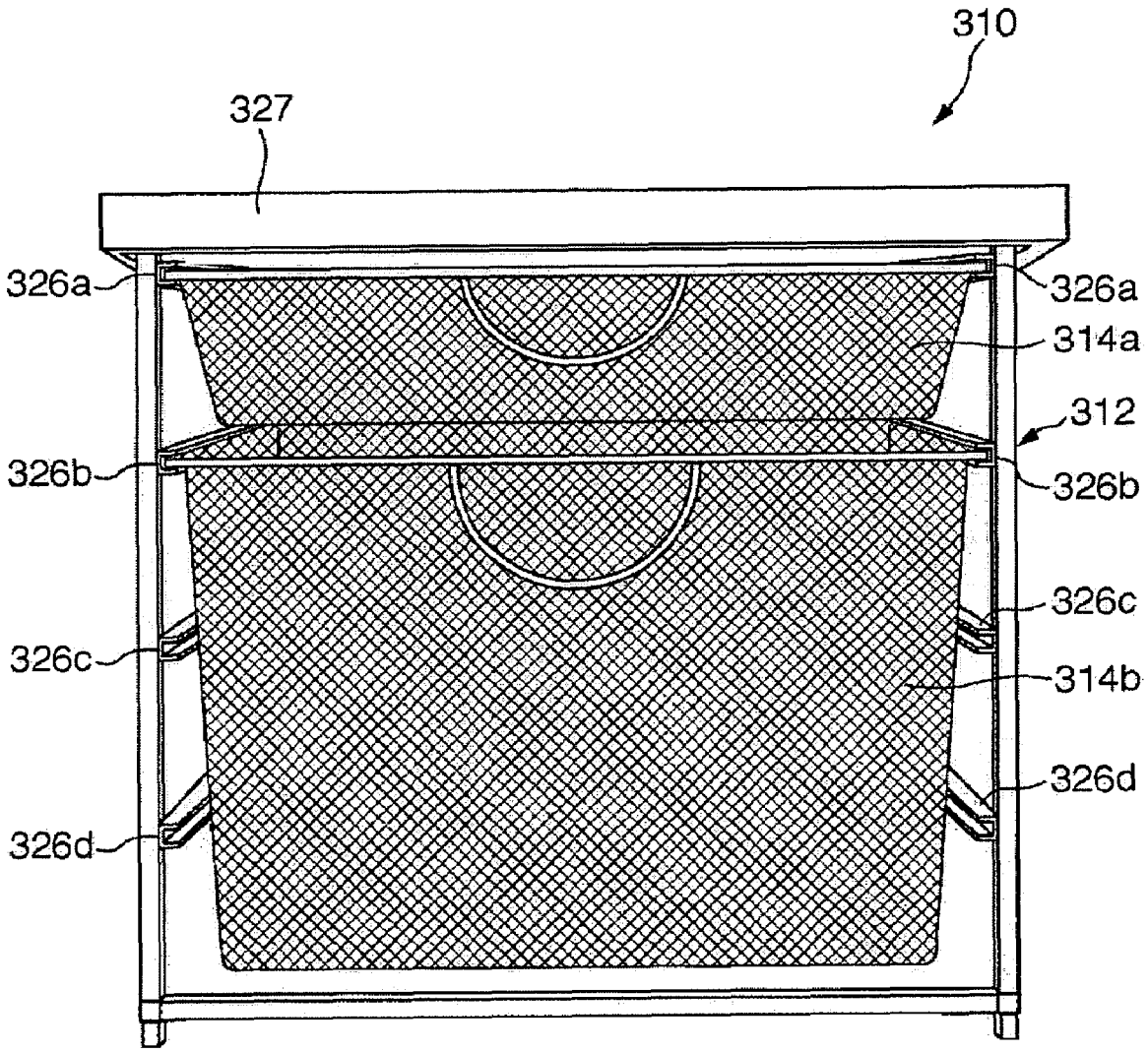
FIG. 18 is front, perspective view of a second preferred embodiment of a system of drawers of the present invention, where the drawers are shown in a retracted position.

Referring to FIG. 18, a second preferred embodiment of a drawer system 310 is shown. Drawer system 310 includes a frame 312 and a plurality of drawers 314*a* and 314*b*. The frame 312 includes four pairs of runners 326*a-d*. This embodiment illustrates that any number of pairs of runners can be used depending on how large a system is desired. The frame 312 is otherwise configured and formed similarly to frame 12 (shown in FIG. 1). The system 310 further may include a solid table top or shelf 327 that is securely connected to the top of frame 312 by a press fit so that objects can be stored or displayed thereon. Alternatively, the shelf 327 may be sized differently (larger or smaller than) the frame 312 and connected to the frame 312 with conventional fasteners such as screws and L-brackets. Drawer 314*a* is small and extends across one pair of runners 326*a*. Drawer 314*b* is large and extends vertically across three pairs of runners 326*b-d*. Drawers 314*a* and 314*b* are configured and manufactured similar to drawer 14*b* (see FIG. 1), but drawers configured like drawers 114*b* and 214*b* can also be used with system 310.

Those skilled in the art will appreciate that the conception, upon which this disclosure is based, may readily be utilized as a basis for designing other products for carrying out the several purposes of the present invention. It is important, therefore, that the claims be regarded as including such equivalent constructions insofar as they do not depart from the spirit and scope of the present invention as defined in the appended claims. Therefore, this invention is not to be limited to the specifically preferred embodiments depicted therein. For example, the features of one embodiment disclosed above can be used with the features of another embodiment. Furthermore, the two different runner portions or upper rail embodiments 54 and 54' can be used exclusively in different systems of drawers to provide systems that cost different amounts, e.g., a high-priced system and a lower priced system. Alternatively, one system can have drawers with both types of rails 54 and 54'. Additionally, a system can use all closed-corner drawers or combine closed-corner drawers with open-corner drawers in one system. The system may be used with sliding drawers and/or stationary and sliding shelves each supported by a pair of runners. The system frame may also include a section for holding hanging file folders and one or more of the inventive drawers. The drawers of the present invention may be used without a frame. In yet another alternative embodiment, the containers/drawers of the present invention may be retained within a frame formed of wood, plastic, metal, or material with a wood finish, where the frame has components such as runners and rollers thereon. The frame would cooperate with a stationary holder with runners and rollers thereon so that the container does not move with respect to the holder, but when the holder moves between an extended and retracted position by moving with respect to the stationary component, the container likewise moves. In such an embodiment, the runner portion serves to connect the container to the holder without a sliding engagement therebetween. In addition, the container can be formed without upper rail 54 (see FIG. 3) by forming the runner portion in another way, such as by folding the upper edge of the basket portion upon itself to form a sufficiently-rigid integral runner portion. Alternatively, the runner portion need not extend around the entire basket and may extend only on the sides to work with the runners 26*a-g* (See FIG. 1). In such an embodiment, the end walls without the runner portions may have upper edges finished with portions of metal, wood, plastic or some other suitable material. Thus, the details of the present invention as set forth in the above-described preferred embodiments should not limit the scope of the present invention.

Further, the purpose of the Abstract is to enable the U.S. Patent and Trademark Office, and the public generally, and especially the designers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

The invention claimed is:

1. Apparatus, comprising:

a frame, and a container, being moveable with respect to said frame between retracted and extended positions, said container further comprising a first piece of metal mesh material bent to form a bottom wall and first and second spaced apart sidewalls extending upwardly from said bottom wall, said bottom wall further including spaced apart first and second edges;

a second piece of metal mesh material formed separate from said first piece of mesh material, said second piece of mesh material joined to said bottom wall adjacent said first edge and bent to form a third sidewall upwardly extending from said bottom wall, said third sidewall further bent to form a central third sidewall portion located between a pair of third sidewall corners, and a third sidewall mesh extension adjacent each third sidewall corner and having an adjacent third sidewall edge; and a third piece of metal mesh material formed separate from said first and second pieces of mesh material, said third piece of mesh material joined to said bottom wall adjacent said second edge and bent to form a fourth sidewall upwardly extending from said bottom wall, said fourth sidewall including fourth sidewall edges, said fourth sidewall further bent to form a central fourth sidewall portion located between a pair of fourth sidewall corners, and a fourth sidewall mesh extension adjacent each fourth sidewall corner and having an adjacent fourth sidewall edge;

said third and fourth sidewall mesh extensions overlap said first and second sidewalls and are joined to said first and second sidewalls to form a basket portion only of metal mesh material wherein said basket portion further includes a free edge;

said container further including a runner portion comprising a compressible rail defining an opening for receiving said free edge of said basket portion, said rail movably connecting said container to said frame.

2. The apparatus of claim 1, wherein said frame further includes a pair of runners each having a gap therein for slidably receiving said runner portion.

* * * * *